US009381746B2

(12) United States Patent
Miyakoshi et al.

(10) Patent No.: US 9,381,746 B2
(45) Date of Patent: Jul. 5, 2016

(54) INK MIST COLLECTION APPARATUS, INK JET PRINTING APPARATUS, AND INK MIST COLLECTION METHOD

(71) Applicant: CANON KABUSHIKI KAISHA, Tokyo (JP)

(72) Inventors: Arihito Miyakoshi, Tokyo (JP); Masahiko Kubota, Tokyo (JP); Nobuhito Yamaguchi, Inagi (JP); Hiroshi Arimizu, Kawasaki (JP); Koichi Ishida, Tokyo (JP); Yoshinori Itoh, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/565,911

(22) Filed: Dec. 10, 2014

(65) Prior Publication Data

US 2015/0165770 A1 Jun. 18, 2015

(30) Foreign Application Priority Data

Dec. 17, 2013 (JP) ..... 2013-260515
Dec. 3, 2014 (JP) ..... 2014-245388

(51) Int. Cl.
*B41J 2/165* (2006.01)
*B41J 2/17* (2006.01)

(52) U.S. Cl.
CPC ..... *B41J 2/1714* (2013.01); *B41J 2/16585* (2013.01)

(58) Field of Classification Search
CPC ..... B41J 2/16505; B41J 2/16523; B41J 2002/14419; B41J 2/16532
See application file for complete search history.

(56) References Cited

U.S. PATENT DOCUMENTS 8,356,881 B2 1/2013 Ohnishi

FOREIGN PATENT DOCUMENTS

| | | | |
|---|---|---|---|
| JP | H9-074091 | A | 3/1997 |
| JP | 2003-068657 | A | 3/2003 |
| JP | 2005-271314 | A | 10/2005 |
| JP | 2005-271316 | A | 10/2005 |
| JP | 2006-068942 | A | 3/2006 |
| JP | 2007-185878 | A | 7/2007 |
| JP | 2010-137483 | A | 6/2010 |

OTHER PUBLICATIONS

Japanese Office Action issued in Japanese Patent Application No. 2014-245388, dated Aug. 11, 2015.

*Primary Examiner* — Lamson Nguyen
(74) *Attorney, Agent, or Firm* — Fitzpatrick, Cella, Harper & Scinto

(57) ABSTRACT

An ink mist collection apparatus capable of suppressing adhesion of ink mist to an inner surface of a suction path, an ink jet printing apparatus, and an ink mist collection method are provided. Air above a print medium is sucked with the ink mist from a suction port through a suction path, the suction port being located downstream with respect to a print head in a conveying direction of the print medium and being opposite to the print medium. Gas is discharged from a discharge port into the inside of the suction path.

15 Claims, 19 Drawing Sheets

INK MIST COLLECTION APPARATUS, INK JET PRINTING APPARATUS, AND INK MIST COLLECTION METHOD

BACKGROUND OF THE INVENTION

1. Field of the Invention

The present invention relates to an ink mist collection apparatus for collecting ink mist that is generated while ink is ejected to print an image, an ink mist collection method, and an ink jet printing apparatus having an ink mist collection apparatus.

2. Description of the Related Art

In an ink jet printing apparatus, when an image is formed on a print medium by ejecting ink droplets from a print head, small ink droplets called ink mist are produced other than ink droplets used for printing an image, and the resulting ink mist may float inside the printing apparatus. Furthermore, the ink mist, due to its small mass, is likely to be affected by airflow caused by relative movement between the print head and the print medium and may adhere to various areas in the printing apparatus. If a large amount of ink mist adheres to the surface of the print head, the ink mist coalesces into a large ink droplet thereby to block an ink ejection port of the print head, leading to a failure in ink ejection and degradation in image quality.

To cope with such ink mist, Japanese Patent Laid-Open No. 2010-137483 discloses a printing apparatus in which a suction port for sucking air above a print medium and a discharge port for discharging air to the print medium are disposed near a print head. This printing apparatus collects ink mist by producing a flow of air discharged from the discharge port and sucked into the suction port and by sucking the ink mist with the air into the sucking port.

In the configuration disclosed in Japanese Patent Laid-Open No. 2010-137483, however, the ink mist sucked into the suction port may adhere to an inner surface of a suction path connected to the suction port, and then coalesce and stick onto the inner surface of the suction path. The stuck ink mist may cause clogging of the suction path, and the performance on ink mist collection may decrease. Furthermore, a huge block of ink mist coalesced on the inner surface of the suction path may drop on the print medium, leading to degradation in image quality.

SUMMARY OF THE INVENTION

The present invention provides an ink mist collection apparatus which can suppress adhesion of ink mist to an inner surface of a suction path, an ink jet printing apparatus, and an ink mist collection method.

In a first aspect of the invention, there is provided an ink mist collection apparatus for collecting ink mist that is produced when an image is printed on a print medium in an ink jet printing apparatus, the ink jet printing apparatus printing the image on the print medium by moving a print head relative to the print medium while ejecting ink from the print head, the ink mist collection apparatus comprising:

a suction unit configured to suck air above the print medium with the ink mist, from a suction port through a suction path, the suction port being located downstream with respect to the print head in a moving direction of the print medium relative to the print head and being opposite to the print medium; and an inner discharge unit configured to discharge gas from an inner discharge port into the inside of the suction path.

In a second aspect of the invention, there is provided an ink jet printing apparatus comprising the ink mist collection apparatus according to the first aspect of the present invention.

In a third aspect of the invention, there is provided an ink mist collection method for collecting ink mist that is produced when an image is printed on a print medium in an ink jet printing apparatus, the ink jet printing apparatus printing the image on the print medium by moving a print head relative to the print medium while ejecting ink from the print head, the method comprising the steps of:

sucking air above the print medium with the ink mist, from a suction port through a suction path, the suction port being located downstream with respect to the print head in a moving direction of the print medium relative to the print head and being opposite to the print medium; and discharging gas into the inside of the suction path.

In a fourth aspect of the invention, there is provided an ink mist collection apparatus comprising:

a suction port located opposite to a print medium and located downstream with respect to an ejection port in a direction of a relative movement of the ejection port and the print medium, the ejection port ejecting ink to the print medium during the relative movement with the print medium; and a suction path that is in communication with the suction port and sucks mist ejected from the ejection port through the suction port, wherein a wall surface of the suction path is provided with a discharge port for discharging gas into the inside of the suction path.

In a fifth aspect of the invention, there is provided an ink mist collection apparatus comprising:

a suction port;

a suction path that is in communication with the suction port and sucks, through the suction port, mist ejected from an ejection port; and a discharge unit configured to discharge gas into the inside of the suction path.

According to the present invention, gas is discharged into the suction path that sucks air above the print medium with the ink mist, thereby producing a layer of airflow near the inner wall of the suction path such that the ink mist is not brought closer to the inner wall of the suction path. As a result, adhesion of the ink mist to the inner wall of the suction path can be suppressed, and the performance on ink mist collection can be maintained.

Further features of the present invention will become apparent from the following description of exemplary embodiments (with reference to the attached drawings).

DESCRIPTION OF THE EMBODIMENTS

Embodiments of the present invention will now be described with reference to the attached drawings.

First Embodiment

An ink jet printing apparatus of the present embodiment is a full-line type printing apparatus using a long print head (line head) and includes a print head and an ink mist collection section which move relative to a print medium.

Figure 1A:
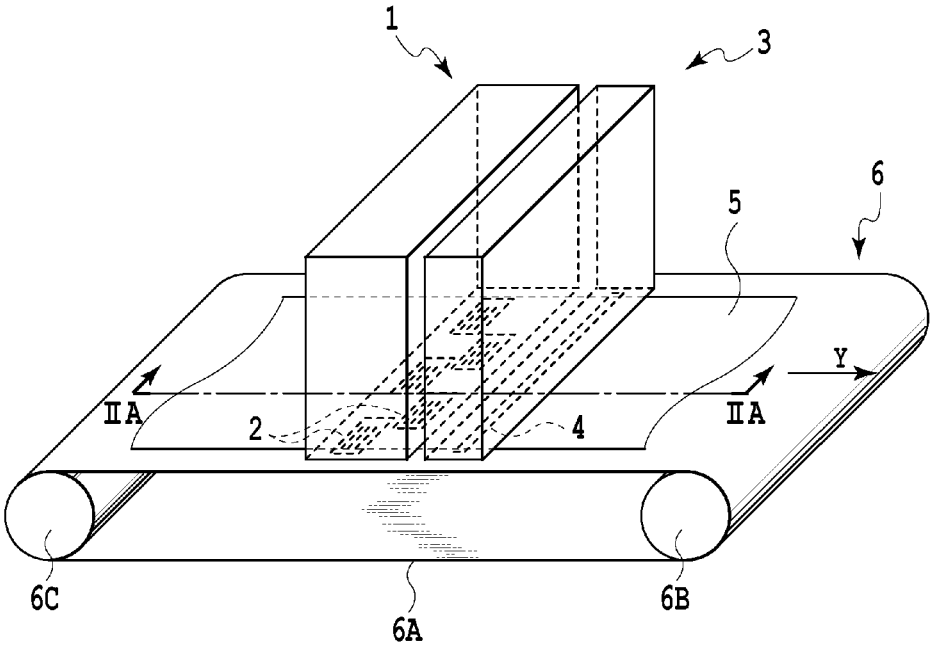
FIGS. 1A and 1B are schematic diagrams of an ink jet printing apparatus according to a first embodiment of the present invention.
Figure 1B:
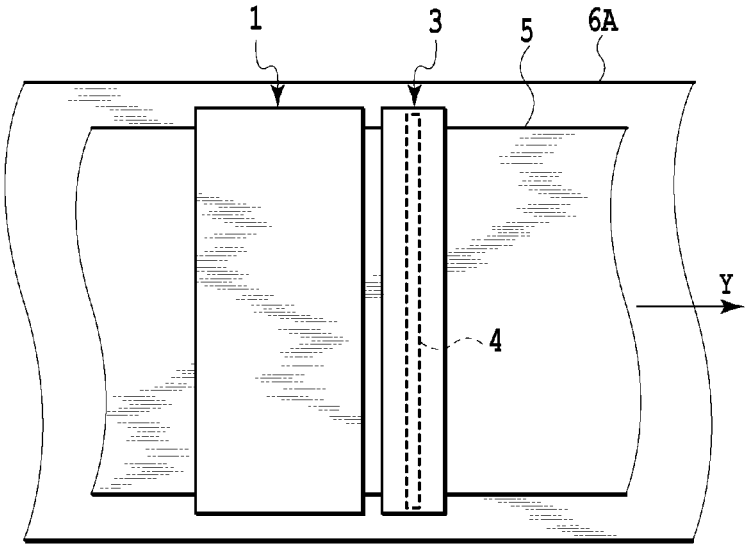

FIG. 1A is a schematic perspective view of a main part of the ink jet printing apparatus of the present example and FIG. 1B is a plan view of a main part of the ink jet printing apparatus of the present example. A print head 1 and an ink mist collection section 3 are disposed above a print medium 5. The print medium 5 moves relative to the print head 1 and the ink mist collection section 3 in a direction shown by arrow Y. In the present example, the print medium 5 is sequentially conveyed in the arrow Y direction by a conveying mechanism 6. The conveying mechanism 6 of the present example is configured to convey the print medium 5 with a conveying belt 6A extending between a driving roller 6B and a follower roller 6C. The configuration of the conveying mechanism 6 is not limited to one with such a conveying belt. The conveying mechanism 6 may use, for example, a conveying roller or the like. The print medium 5 may be chosen from various forms of paper, such as a long roll of paper or paper sheets cut in page units.

The print head 1 is provided with a plurality of ejection ports that can eject ink. The ejection ports are arranged to form ejection port arrays extending in a direction crossing (perpendicular to, in the present example) a conveying direction (arrow Y direction) of the print medium 5. On the print head 1 of the present example, a plurality of chips 2 each provided with a plurality of ejection ports are staggered with respect to each other. The plurality of ejection ports provided for the plurality of chips 2 substantially form ejection port arrays extending in a direction crossing the conveying direction of the print medium 5. The print head 1 is provided with an ejection energy generation element for generating ejection energy to eject ink from an ejection port. Examples of the ejection energy generation element include an electrothermal transducer (heater) and a piezoelectric element. If the electrothermal transducer is used, heating of the electrothermal transducer causes ink to be foamed and the resulting foaming energy allows the ink to be ejected from the ejection port.

While the print medium 5 is sequentially conveyed in the arrow Y direction, ink is ejected from the ejection port of the print head 1 thereby to print an image on the print medium 5.

Figure 2A:
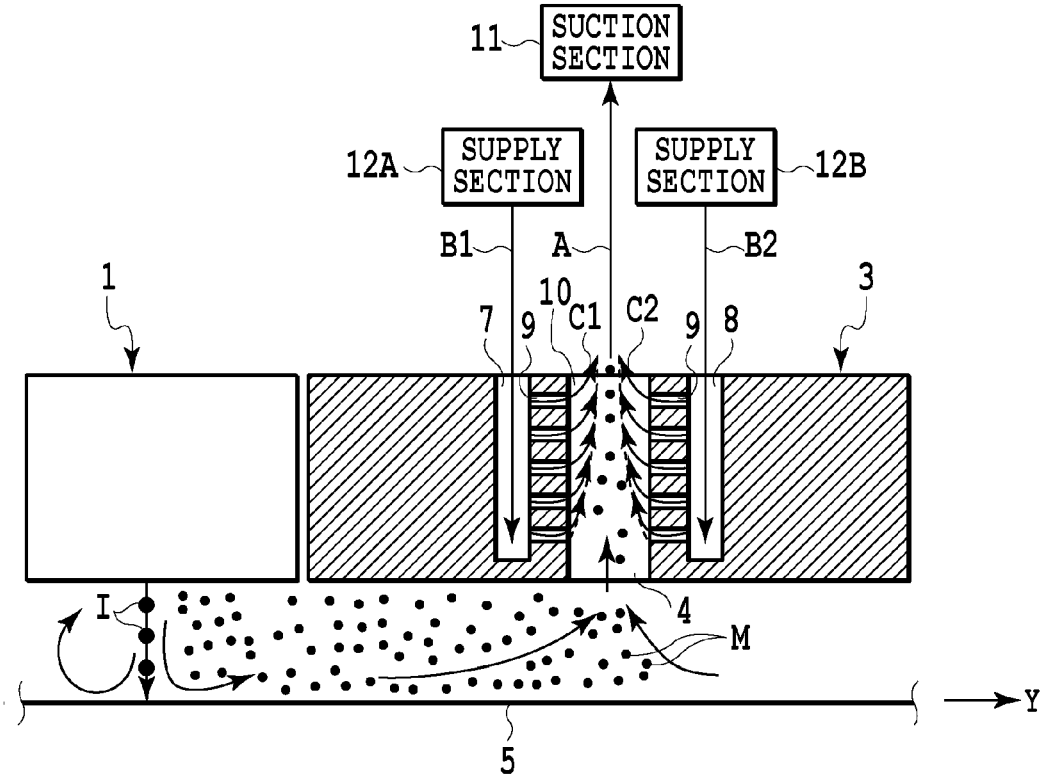
FIG. 2A is an enlarged cross-sectional view of an ink mist collection section taken along line IIA-IIA of FIG. 1A.

In such a printing operation, the print head 1 and the print medium 5 move relative to each other, and accordingly, airflow is produced between the print head 1 and the print medium 5 in the conveying direction shown by arrow Y. Furthermore, as shown in FIG. 2A, not only ink droplets I for printing an image but also small ink droplets called ink mist M are produced. The ink mist M, due to its small mass, is likely to be affected by the airflow produced between the print head 1 and the print medium 5. More specifically, the ink mist M moves along with the airflow in the arrow Y direction.

The collection section 3 is used to collect the ink mist M. The collection section 3 is provided with a suction port 4 at a position opposite to the print medium 5. The suction port 4 is located downstream with respect to the print head 1 in the flowing direction (arrow Y direction) of the airflow. As shown in FIG. 1B, the suction port 4 is in the form of a slit extending across the entire width of the print medium 5 and is in communication with a suction path 10 as shown in FIG. 2A. The suction path 10 is connected to a suction section 11 using a suction fan or the like to suck air in an arrow A direction of FIG. 2A. Side wall portions of the suction path 10 located upstream and downstream in the conveying direction (arrow Y direction) of the print medium 5 are provided with supply paths 7 and 8 to which pressurized air (pressurized gas) is supplied from supply sections 12A and 12B for the pressurized air, respectively. Furthermore, the side wall portion of the suction path 10 is provided with discharge ports (inner discharge ports) 9 for discharging the pressurized air in the supply paths 7 and 8 into the suction path 10. It is also possible to integrate the supply sections 12A and 12B into one and supply the pressurized air from one supply section to the supply paths 7 and 8.

As shown in FIG. 2A, the air in the suction path 10 is sucked in the arrow A direction. This allows the ink mist M floating between the print medium 5 and the collection section 3 to be sucked into the suction path 10 and collected. In the present example, while sucking the air into the suction path 10 in the arrow A direction, the pressurized air in the supply paths 7 and 8 is discharged from the discharge ports 9 into the suction path 10. This promotes formation of a layer of air flowing in directions shown by arrows C1 and C2 near the side wall surface of the suction path 10. The layer of air flowing in the directions shown by arrows C1 and C2 prevents the ink mist M from coming closer to the side wall surface of the suction path 10. As a result, the ink mist M can be collected without adhering to the side wall surface of the suction path 10. Furthermore, since the air flowing in the directions shown by arrows C1 and C2 is added to the air flowing in the arrow A direction, it is possible to increase the flow rate of the air flowing in the suction path 10 for collecting the ink mist M relative to the flow rate of the air flowing between the print medium 5 and the collection section 3.

Figure 2B:
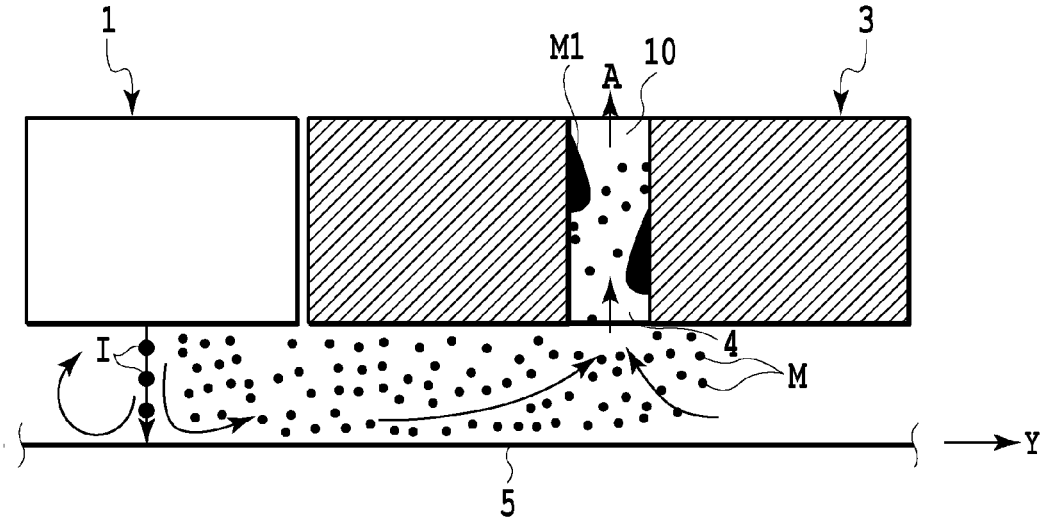
FIG. 2B is an enlarged cross-sectional view of an ink mist collection section as a comparative example.

If the supply paths 7 and 8 and the discharge ports 9 are not provided, in a state where there is no flow of air in the directions shown by arrows C1 and C2 as shown in FIG. 2B, it is required to increase the rate of the air sucked into the suction path 10 relative to the flow rate of the air flowing between the print medium 5 and the collection section 3. Furthermore, since there is no flow of air in the directions shown by arrows C1 and C2, the ink mist M adheres to the inner wall surface of the suction path 10, and the adhering ink mist M may coalesce into a large ink droplet M1 and stick to the suction path 10. In this case, the suction path 10 may be blocked and the performance on collection of ink mist M may decrease.

Figure 3A:
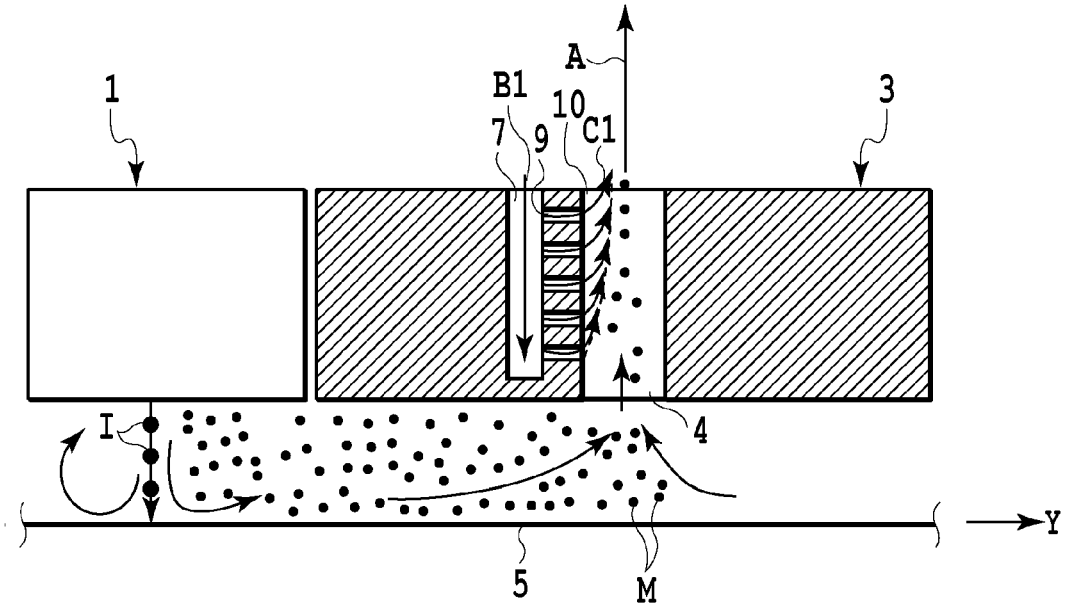
FIG. 3A illustrates another exemplary configuration of the ink mist collection section of FIG. 2A.
Figure 3B:
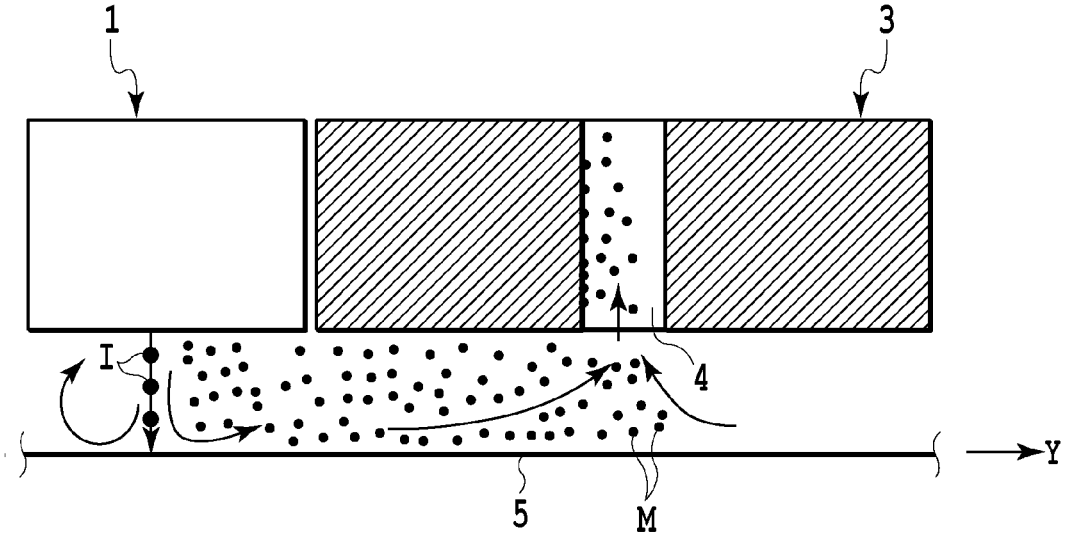
FIG. 3B illustrates an ink mist collection section as a comparative example.

In a case where the ink mist M is collected only by the suction of the air within the suction path 10 as shown in FIG. 2B, the ink mist M is likely to adhere to the inner wall surface of the suction port 10, particularly to a portion of the inner wall surface located upstream in the conveying direction (arrow Y direction) of the print medium 5 as shown in FIG. 3B. Accordingly, to suppress adhesion of the ink mist to the inner wall surface of the suction port 10, as shown in FIG. 3A, providing only the supply path 7 upstream with respect to the suction path 10 in the conveying direction and the discharge ports 9 is effective. In this case, the air in the supply path 7 is discharged in the arrow C1 direction from the discharge ports 9 located upstream with respect to the suction path 10 in the conveying direction. Alternatively, it is possible to provide only the supply path 8 located downstream with respect to the suction path 10 in the conveying direction and the discharge ports 9. More specifically, either a set of the supply path 7 and the discharge ports 9 or a set of the supply path 8 and the discharge ports 9 may be provided.

Figure 4A:
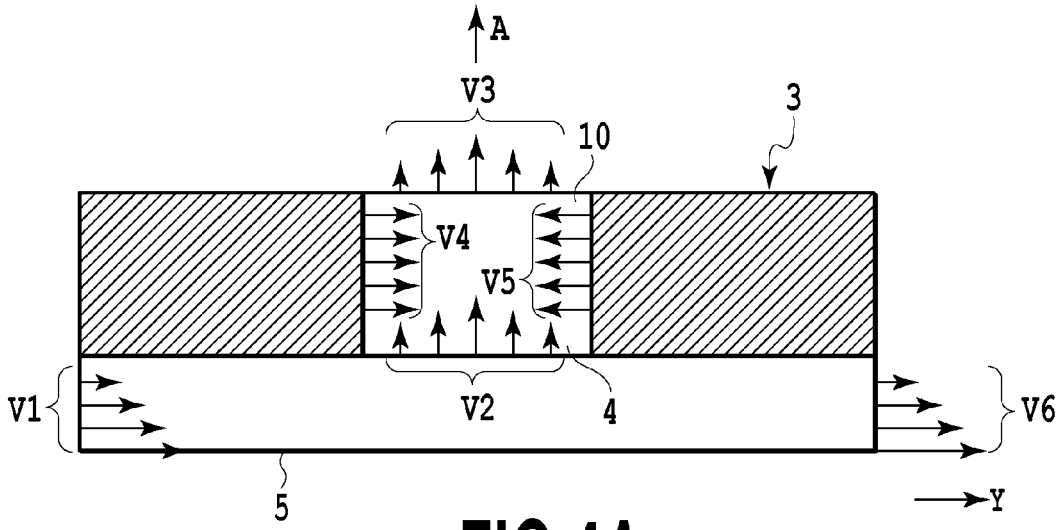
FIGS. 4A and 4B illustrate airflow in the ink mist collection section of FIG. 2A.
Figure 4B:
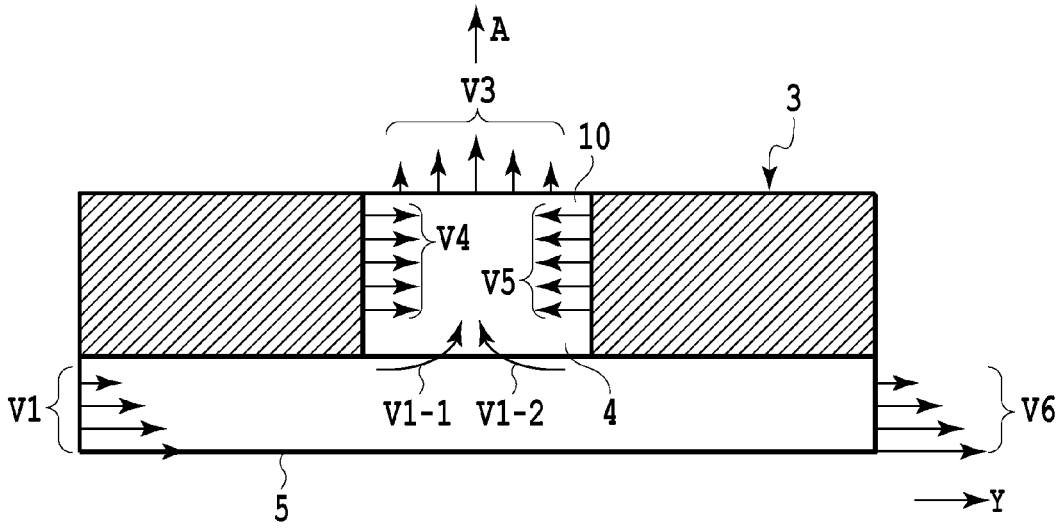

FIG. 4A illustrates the flow rate of the air flowing between the print medium 5 and the collection section 3 and the flow rate of the air flowing in the suction path 10. In an area between the print medium 5 and the collection section 3, the flow rate of the air flowing from the arrow Y direction into the space between the print medium 5 and the collection section 3 is set as V1. The flow rate of the air flowing from the suction port 4 into the suction path 10 is set as V2. The flow rate of the air sucked from the suction path 10 is set as V3. The flow rate of the air discharged from the supply path 7 into the suction path 10 is set as V4. The flow rate of the air discharged from the supply path 8 into the suction path 10 is set as V5. The flow rate of the air flowing from the space between the print medium 5 and the collection section 3 in the arrow Y direction is set as V6. The flow rate V2, as shown in FIG. 4B, is considered as the sum of V1−1, which is the flow rate of the air flowing from an upstream area in the conveying direction of the print medium 5 into the suction port 4, and V1−2, which is the flow rate of the air flowing from a downstream area in the conveying direction of the print medium 5 into the suction port 4. The relation is expressed by the following formula (1).

$$V2=(V1-1)+(V1-2) \quad (1)$$

Based on the flow rate conservation law, the flow rate V1−2 can be expressed by the following formula (2).

$$(V1-2)=V3-\{(V1-1)+V4+V5\} \quad (2)$$

If (V1−2) is smaller than 0, that is, if the following formula (3) is satisfied, airflow is produced at the suction port 4 in a direction opposite to a suction direction shown by arrow A.

$$V3<\{(V1-1)+V4+V5\} \quad (3)$$

Figure 5A:
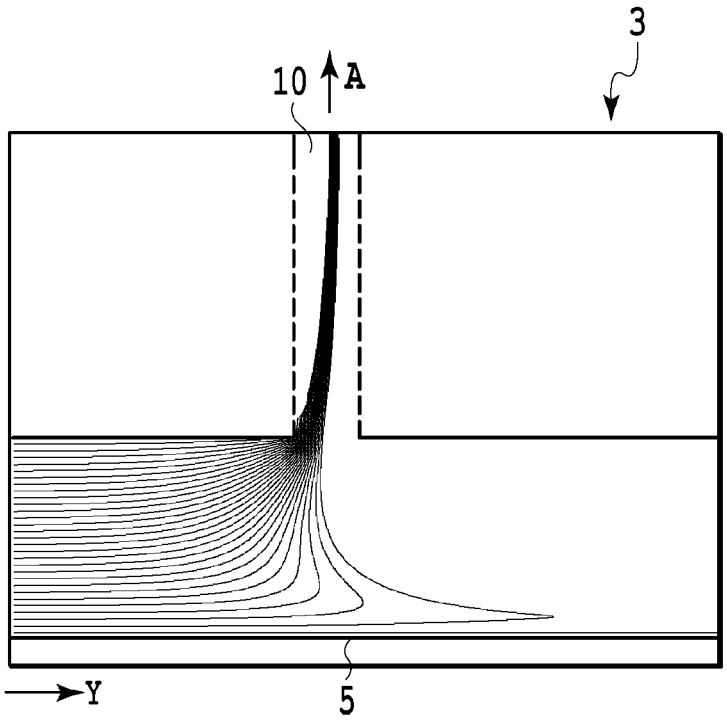
FIG. 5A illustrates a trajectory of ink mist in the ink mist collection section of FIG. 2A.
Figure 5B:
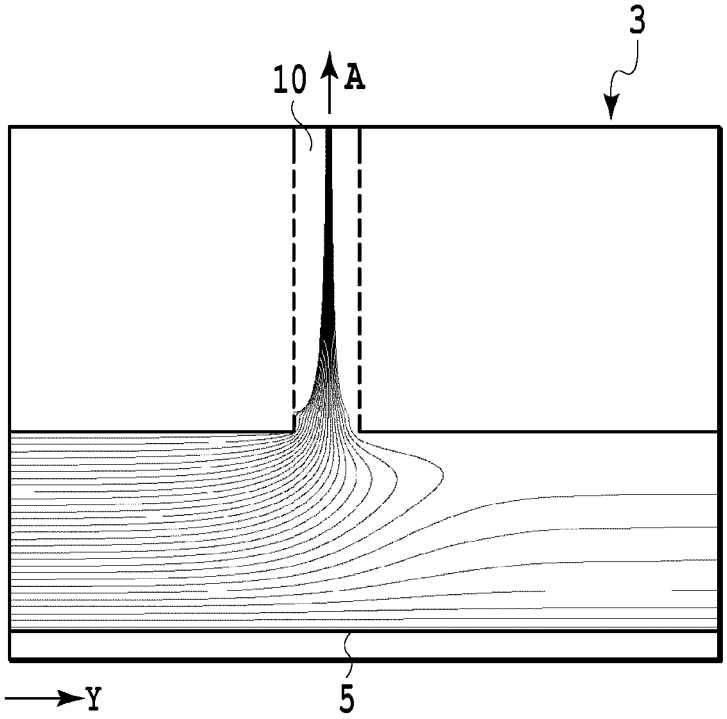
FIG. 5B illustrates a trajectory of ink mist in an ink mist collection section as a comparative example.

FIG. 5A illustrates a movement trajectory of ink mist when airflow is produced near the suction port 4 in a direction opposite to the suction direction shown by arrow A, in a case where the ink mist M is collected as shown in FIG. 2A by the suction into the suction path 10 and the discharge of the air from the supply paths 7 and 8. FIG. 5B illustrates a movement trajectory of ink mist when airflow is not produced in a direction opposite to the suction direction shown by arrow A. As apparent from FIGS. 5A and 5B, when airflow is produced at the suction port 4 in a direction opposite to the suction direction shown by arrow A, the amount of collected ink mist is decreased.

On the other hand, if (V1−2) is equal to or greater than 0, that is, if the following formula (4) is satisfied, airflow is not produced at the suction port 4 in a direction opposite to the suction direction shown by arrow A.

$$V3\geq\{(V1-1)+V4+V5\} \quad (4)$$

The formulas (2) and (4) above can also be represented by the following formula (2') and (4'), respectively.

$$V\text{in}2=V\text{out}-(V\text{in}1+V\text{in}3) \quad (2')$$

$$V\text{out}\geq V\text{in}1+V\text{in}3 \quad (4')$$

Vin1 is an amount of airflow sucked from an upstream area with respect to the suction port 4 in the conveying direction (arrow Y direction) into the suction port 4, and corresponds to the flow rate V1−1. Vin2 is an amount of airflow sucked from a downstream area with respect to the suction port 4 in the conveying direction into the suction port 4, and corresponds to the flow rate V1−2. Vin3 is an amount of gas discharged from the discharge port 9 into the suction path 10, and corresponds to the flow rate (V4+V5). Vout is an amount of gas and air sucked into the suction port 10, and corresponds to the flow rate V3.

In the present embodiment, the suction into the suction path 10 and the discharge of the air from the supply paths 7 and 8 allow efficient collection of the ink mist M while suppressing adhesion of the ink mist M to the side wall surface of the suction path 10, so that the performance on ink mist collection can be maintained. Furthermore, by setting the flow rate V3 of the air from the suction path 10 so as not to produce airflow at the suction port 4 in a direction opposite to the suction direction shown by arrow A, the ink mist M can be collected more efficiently.

Second Embodiment

In the present embodiment, even when a conveying speed of the print medium 5 changes in the first embodiment, it is possible to suppress the adhesion of the ink mist M to the side wall surface of the suction path 10 and stably collect the ink mist M.

Figure 6:
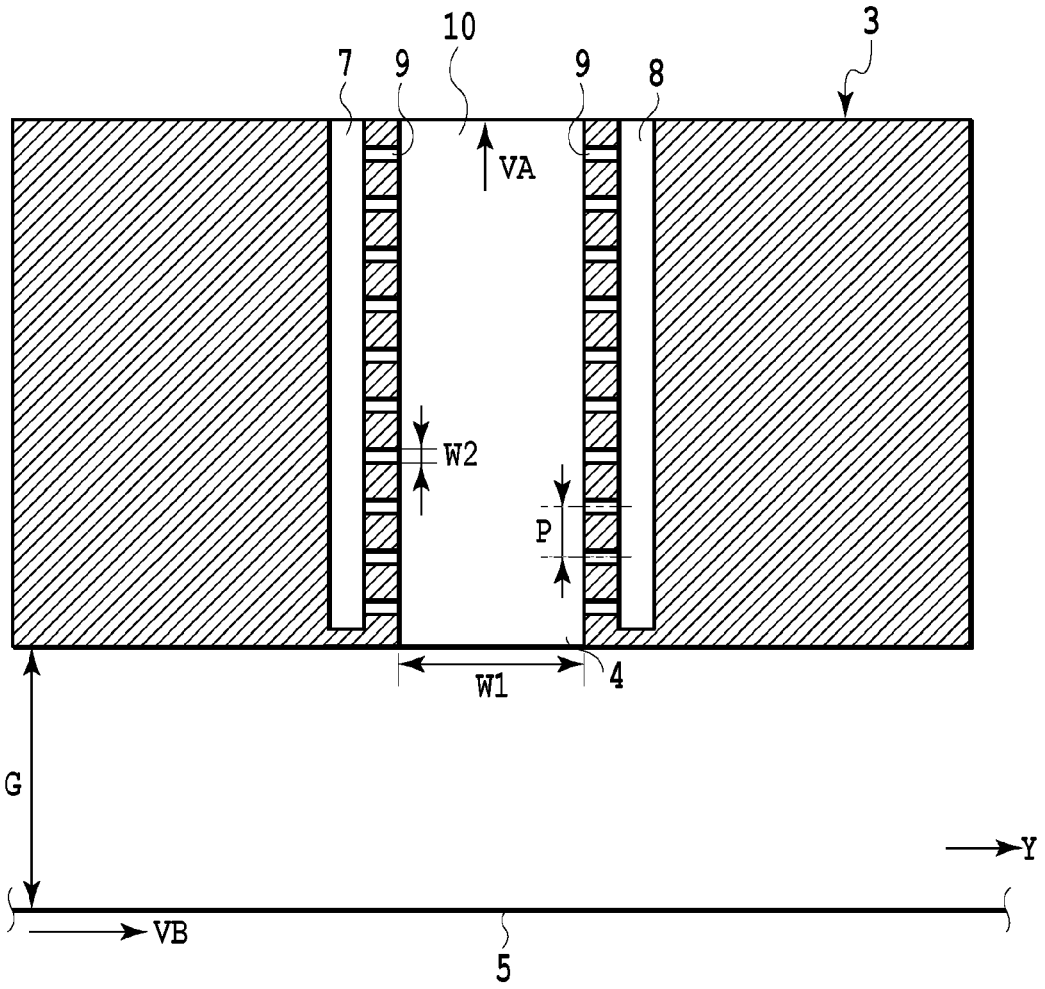
FIG. 6 is an enlarged view of a main part of an ink mist collection section according to a second embodiment of the present invention.

In FIG. 6, a width W1 of the suction port 4 in the collection section 3 is 500 [μm], a suction speed VA of the air from the suction path 10 is 3 to 6 [m/s], and a width W2 of the discharge port 9 is 20 [μm]. The number of discharge ports 9 at the side of the supply path 7 is 10 and the number of discharge ports 9 at the side of the supply path 8 is also 10. An interval P between the discharge ports is 200 [μm], a conveying speed VB of the print medium 5 is 0.61 to 2.4 [m/s], and a distance G between the print medium 5 and the collection section 3 is 1.0 to 2.0 [mm].

In the present embodiment, like the above-described embodiment, the ink mist M is collected as shown in FIG. 2A by the suction into the suction path 10 and the discharge of the air from the supply paths 7 and 8. In this configuration, a distance between the side wall surface of the suction path 10 and the ink mist M passing through the suction path 10 is equal to or greater than 150 [μm] if the relation of the above-mentioned formula (4) in which airflow is not produced at the suction port 4 in a direction opposite to the suction direction shown by arrow A is satisfied, and also the following formula (5) is satisfied.

$$\{V3-(V1-1)\}\times 0.25 \leq V4 \leq \{V3-(V1-1)\}\times 0.6 \quad (5)$$

In a case where the distance between the side wall surface of the suction path 10 and the ink mist M is 125 [μm], even if the conveying speed VB of the print medium 5 changes by 10% and the balance between the flow rate in the collection section 3 and the flow rate in an adjacent area changes, the ink mist M does not adhere to the side wall surface of the suction path 10. In this manner, if there is a sufficient distance between the side wall surface of the suction path 10 and the ink mist M, even when the conveying speed VB of the print medium 5 changes, it is possible to suppress the adhesion of the ink mist M to the side wall surface of the suction path 10 and maintain the performance on collection of the ink mist M.

Third Embodiment

Figure 7A:
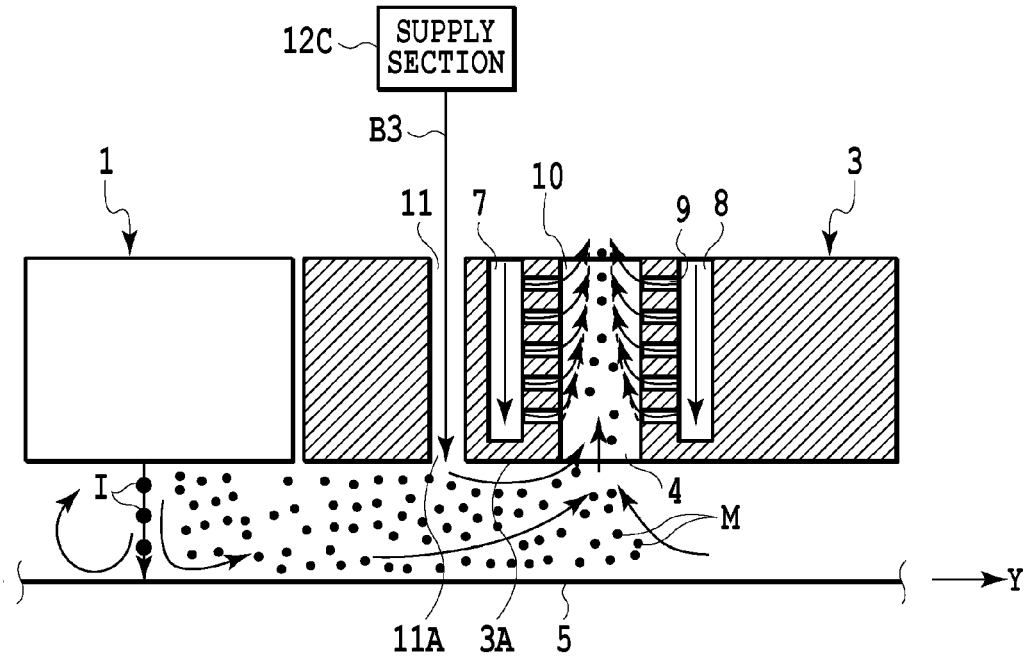
FIG. 7A is an enlarged cross-sectional view of an ink mist collection section according to a third embodiment of the present invention.

In the present embodiment, as shown in FIG. 7A, a supply path 11 for receiving pressurized air (pressurized gas) from a supply section 12C is formed at a portion of the collection section 3 located upstream with respect to the suction port 4 in the conveying direction (arrow Y direction). An end of the supply path 11 is provided with a discharge port (upstream discharge port) 11A for discharging air supplied from the supply section 12C to the supply path 11 to the space between the collection section 3 and the print medium 5. It is also possible to integrate the supply section 12C and the supply sections 12A and 12B of FIG. 2A according to the above-described embodiments into one and supply the pressurized air from one supply section to the supply paths 7, 8, and 11.

Figure 7B:
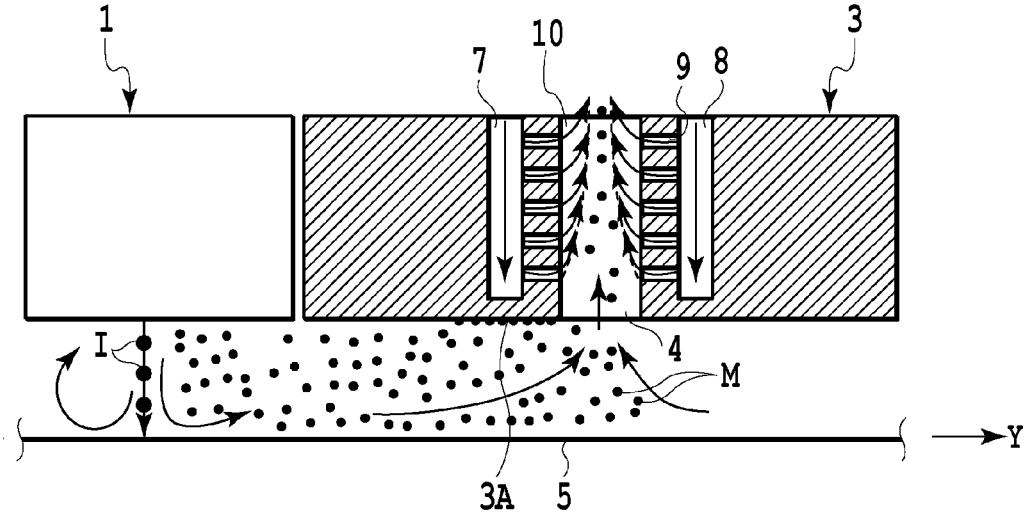
FIG. 7B is an enlarged cross-sectional view of an ink mist collection section as a comparative example.

By discharging air from the discharge port 11A to the space between the collection section 3 and the print medium 5 in this manner, a layer of air flowing from the discharge port 11A toward the suction port 4 is formed. The layer of air prevents the ink mist M from adhering to an opening surface of the suction port 4 located upstream with respect to the suction port 4 in the conveying direction (arrow Y direction), that is, a surface 3A of the collection section 3 located between the discharge port 11A and the suction port 4. More specifically, as compared to the case shown in FIG. 7B in which the supply path 11 and the discharge port 11A are not formed, it is possible to suppress the adhesion of the ink mist M that may adhere to the surface 3A of the collection section 3 as shown in FIG. 7B.

In a case where an amount of air discharged from the discharge port 11A is small, a thickness of the layer of the airflow is small. Accordingly, after reaching the suction port 4, the air flows near the upstream side wall surface of the suction path 10 in the conveying direction (arrow Y direction). In this case, depending on the flow of the air, the ink mist M may adhere to the upstream side wall surface of the suction path 10 in the conveying direction. To suppress the adhesion of the ink mist M to the side wall surface in the suction path 10, in connection with the amount of air discharged from the discharge port 11A, the amount of air discharged from the discharge ports 9 of at least one of the supply paths 7 and 8 is set.

More specifically, first, air is not discharged from the discharge ports 9 of the supply paths 7 and 8 but air is discharged from the discharge port 11A of the supply path 11. In a case where the air is sucked into the suction path 10 from an upstream area with respect to the central position (midpoint between the upstream end and the downstream end in the conveying direction) of the suction port 4 in the conveying direction, the air is discharged from the discharge ports 9 of at least the supply path 7. Then, the amount of air discharged from the discharge ports 9 is set such that the position at which the air discharged from the discharge port 11A is sucked into the suction path 10 comes closer to the central position of the suction port 4. Accordingly, it is possible to further suppress the adhesion of the ink mist M to the side wall surface of the suction path 10.

Figure 8A:
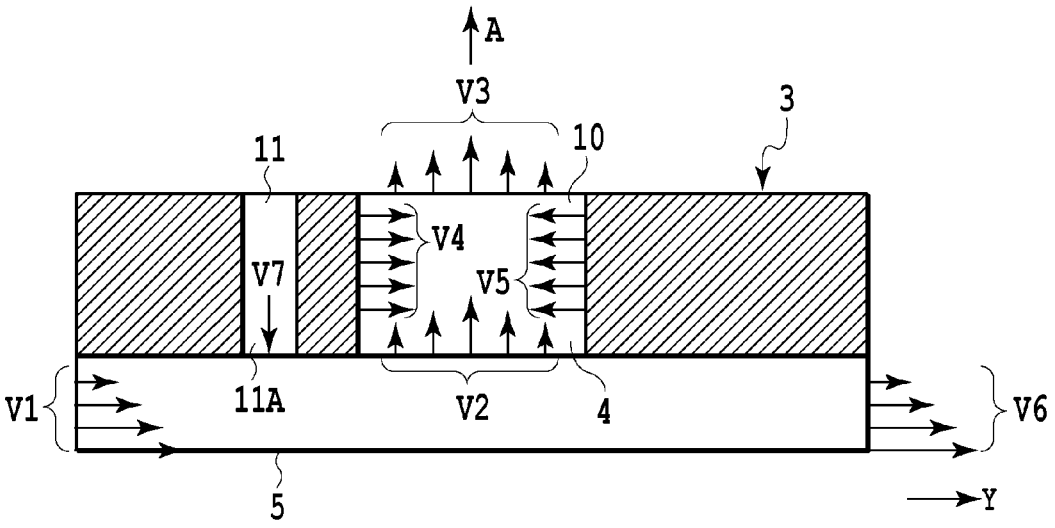
FIGS. 8A and 8B illustrate airflow in the ink mist collection section of FIG. 7A.
Figure 8B:
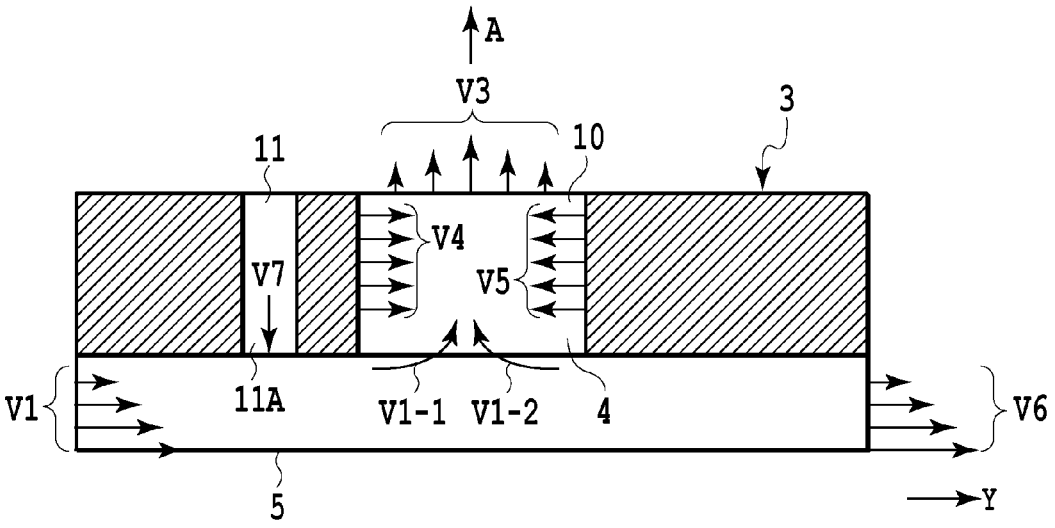

FIG. 8A illustrates the flow rate of the air between the print medium 5 and the collection section 3 and the flow rate of the air in the suction path 10. The flow rate of the air discharged from the discharge port 11A of the supply path 11 is set as V7. The flow rates V1 to V6 are the same as those of the above embodiments. The flow rate V2, as shown in FIG. 8B, is considered as the sum of V1−1, which is the flow rate of the air flowing from an upstream area in the conveying direction of the print medium 5 into the suction port 4, V1−2, which is the flow rate of the air flowing from a downstream area in the conveying direction of the print medium 5 into the suction port 4, and V7, which is the flow rate of the air from the discharge port 11A. The relation is represented by the following formula (6).

$$V2=(V1-1)+(V1-2)+V7 \quad (6)$$

Based on the flow rate conservation law, the flow rate V1−2 can be represented by the following formula (7).

$$(V1-2)=V3-\{(V1-1)+V4+V5+V7\} \quad (7)$$

If (V1−2) is smaller than 0, that is, if the following formula (8) is satisfied, airflow is produced at the suction port 4 in a direction opposite to a suction direction shown by arrow A.

$$V3<\{(V1-1)+V4+V5+V7\} \quad (8)$$

Figure 9A:
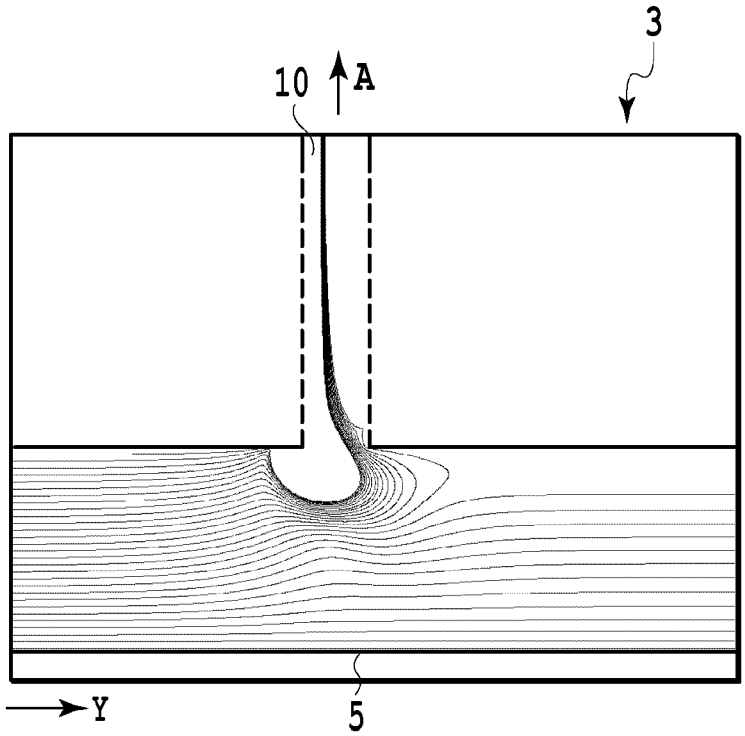
FIG. 9A illustrates a trajectory of ink mist in the ink mist collection section of FIG. 7A.
Figure 9B:
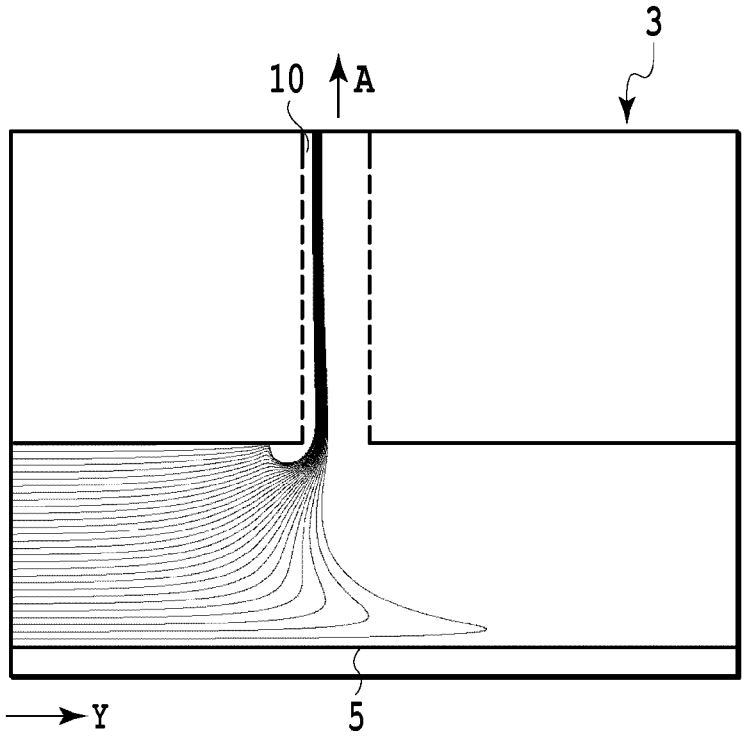
FIG. 9B illustrates a trajectory of ink mist in an ink mist collection section as a comparative example.

FIG. 9A illustrates a movement trajectory of ink mist M when airflow is produced at the suction port 4 in a direction opposite to the suction direction shown by arrow A, in a case where the ink mist M is collected as shown in FIG. 7A by the suction into the suction path 10 and the discharge of the air from the supply paths 7 and 8. FIG. 9B illustrates a movement trajectory of ink mist M when airflow is not produced in a direction opposite to the suction direction shown by arrow A. As apparent from FIGS. 9A and 9B, when airflow is produced at the suction port 4 in a direction opposite to the suction direction shown by arrow A, the amount of collected ink mist is decreased.

On the other hand, if (V1−2) is equal to or greater than 0, that is, if the following formula (9) is satisfied, airflow is not produced at the suction port 4 in a direction opposite to the suction direction shown by arrow A.

$$V3\geq\{(V1-1)+V4+V5+V7\} \quad (9)$$

The formulas (7) and (9) above can also be represented by the following formulas (7') and (9'), respectively.

$$Vin2=Vout-(Vin1+Vin3) \quad (7')$$

$$Vout \geq Vin1+Vin3 \quad (9')$$

In the present embodiment, an amount Vin1 corresponds to {(V1−1)+V7}, an amount Vin2 to V1−2, an amount Vin3 to (V4+V5), and a suction amount Vout to the flow rate V3.

In this embodiment, the suction into the suction path 10 and the discharge of the air from the supply paths 7, 8, and 11 allow efficient collection of the ink mist M while suppressing adhesion of the ink mist M to the side wall surface of the suction path 10 and to the opening surface 3A of the suction port 4.

Forth Embodiment

In the present embodiment, even when a conveying speed of the print medium 5 changes in the third embodiment, it is possible to suppress the adhesion of the ink mist M to the side wall surface of the suction path 10 and to the opening surface 3A of the suction port 4 and stably collect the ink mist M.

Figure 10:
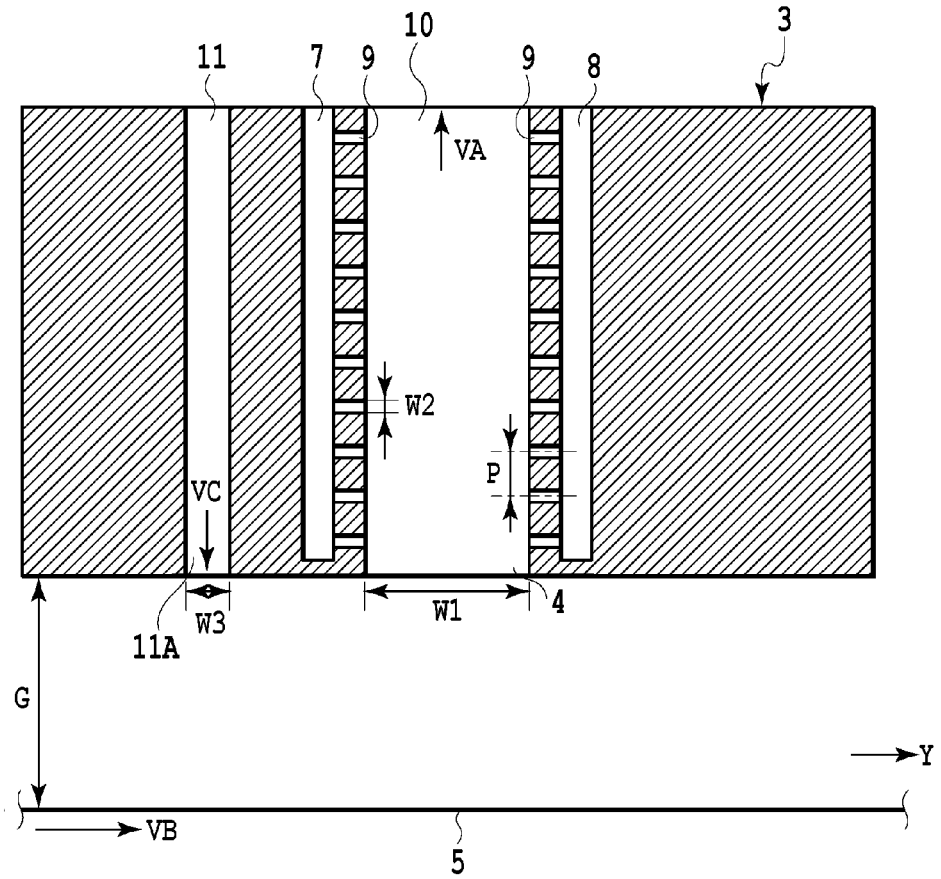
FIG. 10 is an enlarged view of a main part of an ink mist collection section according to a fourth embodiment of the present invention.

In FIG. 10, a width W3 of the discharge port 11A of the supply path 11 is 50 [μm], and a discharge speed VC of the air from the discharge port 11A is 4 [m/s]. The widths W1 and W2, the interval P, the distance G, and the number of discharge ports 9 are the same as those of the second embodiment.

In the present embodiment, like the above-described third embodiment, the ink mist M is collected as shown in FIG. 7A by the suction into the suction path 10 and the discharge of the air from the supply paths 7, 8, and 11. In this configuration, a distance between the side wall surface of the suction path 10 and the ink mist M passing through the suction path 10 is equal to or greater than 125 [μm] if the relation of the above-mentioned formula (9) in which airflow is not produced at the suction port 4 in a direction opposite to the suction direction shown by arrow A is satisfied, and also the following formula (10) is satisfied.

$$\{V3-(V1-1)-V7\}\times 0.15 \leq V4 \leq \{V3-(V1-1)-V7\}\times 0.6 \quad (10)$$

In a case where the distance between the side wall surface of the suction path 10 and the ink mist M is 125 [μm], even if the conveying speed VB of the print medium 5 changes by 10% and the balance between the flow rate in the collection section 3 and the flow rate in an adjacent area changes, the ink mist M does not adhere to the side wall surface of the suction path 10. The ink mist M does not even adhere to the opening surface 3A of the suction port 4. In this manner, if there is a sufficient distance between the side wall surface of the suction path 10 and the ink mist M, even when the conveying speed VB of the print medium 5 changes, it is possible to suppress the adhesion of the ink mist M and maintain the performance on collection of the ink mist M.

Fifth Embodiment

Figure 11:
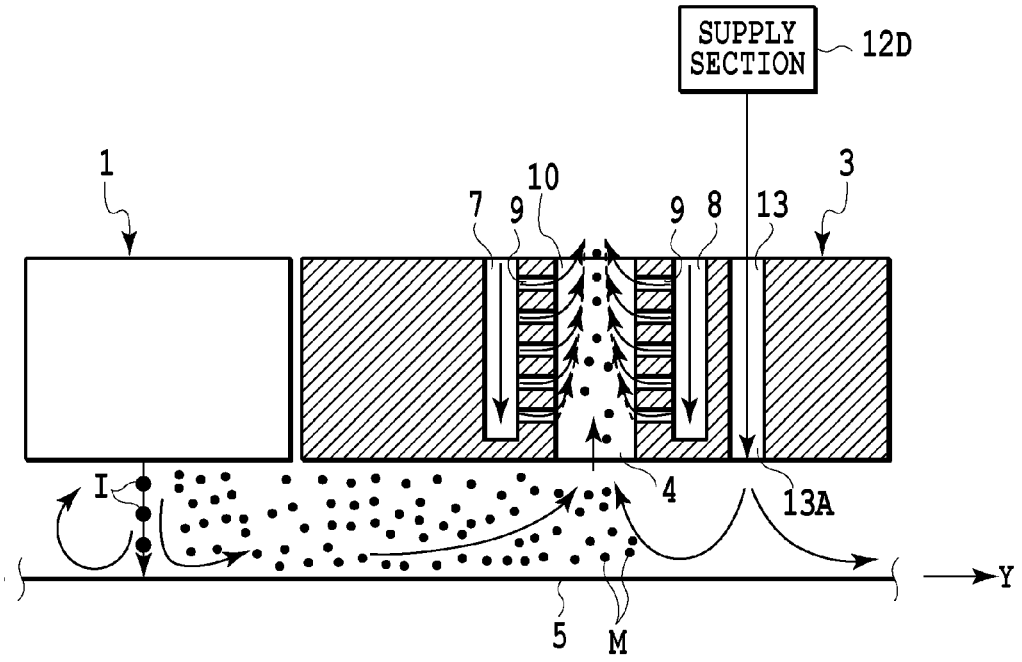
FIG. 11 is an enlarged cross-sectional view of an ink mist collection section according to a fifth embodiment of the present invention.

In the above-described first embodiment, to ensure that the ink mist M floating near the print medium 5 is collected, it is necessary that a large amount of air is sucked into the suction path 10. This may decrease the collection efficiency of the ink mist M. In the present embodiment, as shown in FIG. 11, in the configuration of the first embodiment, a supply path 13 for receiving pressurized air (pressurized gas) from a supply section 12D is formed at a portion of the collection section 3 downstream with respect to the suction port 4 in the conveying direction (arrow Y direction). An end of the supply path 13 is provided with a discharge port (downstream discharge port) 13A for discharging air that is supplied from the supply section 12D to the supply path 13 into the space between the collection section 3 and the print medium 5. It is also possible to integrate the supply section 12D and the supply sections 12A and 12B of FIG. 2A according to the above-described embodiments into one and supply the pressurized air from one supply section to the supply paths 7, 8, and 13.

The air in the supply path 13 is discharged from the discharge port 13A in a direction substantially perpendicular to the surface of the print medium 5. By discharging the air from the discharge port 13A to reach the print medium 5, the ink mist M floating near the surface of the print medium 5 is blown up toward the suction port 4. As a result, the ink mist M can be efficiently collected without increasing the amount of air sucked from the suction path 10.

Figure 12:
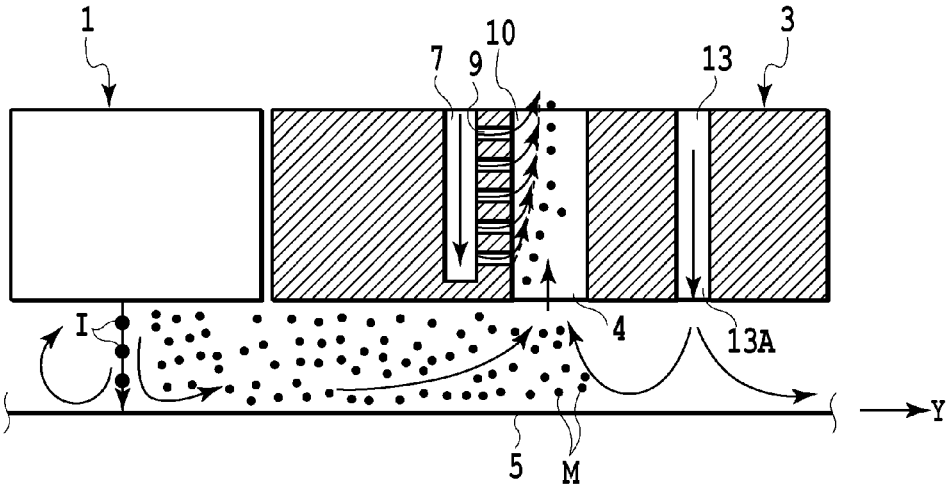
FIG. 12 illustrates another exemplary configuration of the ink mist collection section of FIG. 11.

The air discharged from the discharge port 13A is, as shown in FIG. 11, diverted into the flow toward the suction port 4 and the flow from the discharge port 13A toward a downstream area in the conveying direction. In a configuration in which the supply paths 7 and 8 and the discharge ports 9 are not formed, it is assumed that the amount of air discharged from the discharge port 13A is sufficiently smaller than the amount of air sucked from the suction path 10. In this case, the air downstream with respect to the discharge port 13A in the conveying direction also flows into the suction port 4, and the ink mist M may adhere to the upstream side wall surface of the suction path 10 in the conveying direction. In such a case, as the discharge amount of the air from the discharge port 13A increases, the flow from the discharge port 13A toward the suction port 4 is produced. Accordingly, in the configuration in which the supply paths 7 and 8 and the discharge ports 9 are not formed, regardless of the amount of air discharged from the discharge port 13A, the ink mist M may adhere to the upstream side wall surface of the suction path 10 in the conveying direction. In the present embodiment, to suppress the adhesion of the ink mist M while increasing the collection efficiency of the ink mist M, the supply paths 7 and 8 and the discharge ports 9 are provided as shown in FIG. 11 and the air is discharged from the discharge ports 9. Furthermore, at least the supply path 7 and the discharge ports 9 may be provided as shown in FIG. 12 to discharge the air from the discharge ports 9.

Figure 13A:
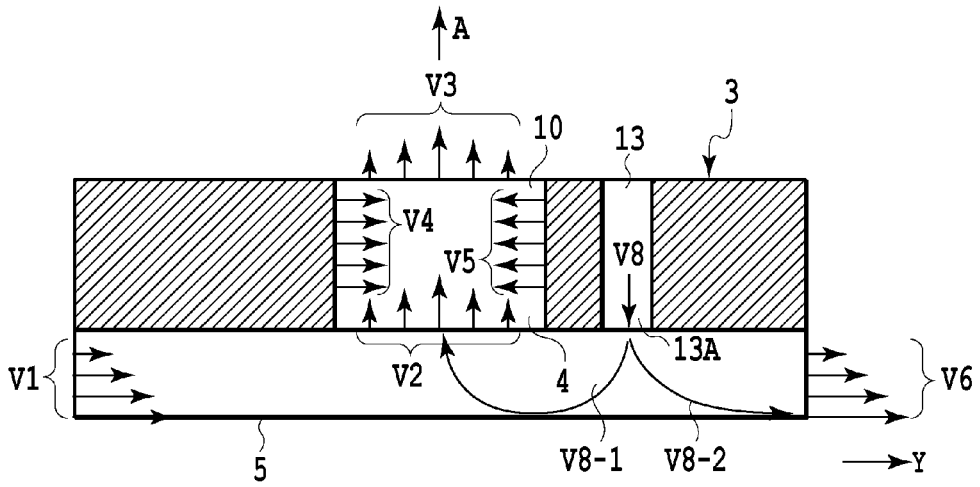
FIGS. 13A and 13B illustrate airflow in the ink mist collection section of FIG. 11.

FIG. 13A illustrates the flow rate of the air between the print medium 5 and the collection section 3 and the flow rate of the air in the suction path 10. The flow rate of the air discharged from the discharge port 13A of the supply path 13 is set as V8. The flow rates V1 to V6 are the same as those of the above embodiments. As described above, the air discharged from the discharge port 13A is diverted into the flow toward the suction port 4 and the flow from the discharge port 13A toward a downstream area in the conveying direction. The flow rate of the air flowing from the discharge port 13A to the suction port 4 is set as V8−1, and the flow rate of the air flowing from the discharge port 13A toward a downstream area in the conveying direction is set as V8−2. The flow rate V8−1 is represented by the following formula (11).

$$(V8-1)=V8-(V8-2) \quad (11)$$

Figure 13B:
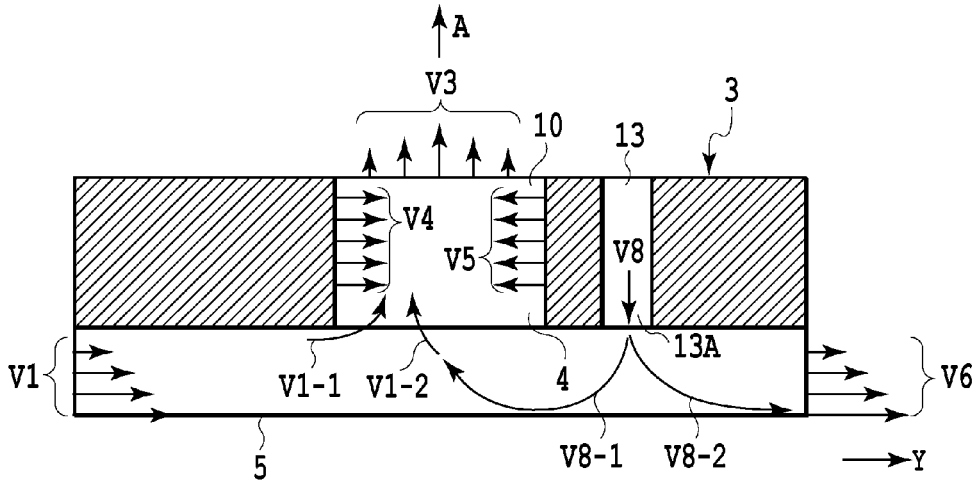

The flow rate V2, as shown in FIG. 13B, is considered as the sum of V1−1, which is the flow rate of the air flowing from an upstream area in the conveying direction into the suction port 4, V1−2, which is the flow rate of the air flowing from a downstream area in the conveying direction to the suction port 4, and V8−1, which is the flow rate of the air flowing from the discharge port 13A into the suction port 4. The relation is represented by the following formula (12).

$$V2=(V1-1)+(V1-2)+(V8-1) \quad (12)$$

Based on the flow rate conservation law, the flow rate V1−2 can be represented by the following formula (13).

$$(V1-2)+(V8-1)=V3-\{(V1-1)+V4+V5\} \quad (13)$$

If {(V1−2)+(V8−1)} is smaller than 0, that is, if the following formula (14) is satisfied, airflow is produced at the suction port 4 in a direction opposite to a suction direction shown by arrow A.

$$V3<\{(V1-1)+V4+V5\} \quad (14)$$

Figure 14A:
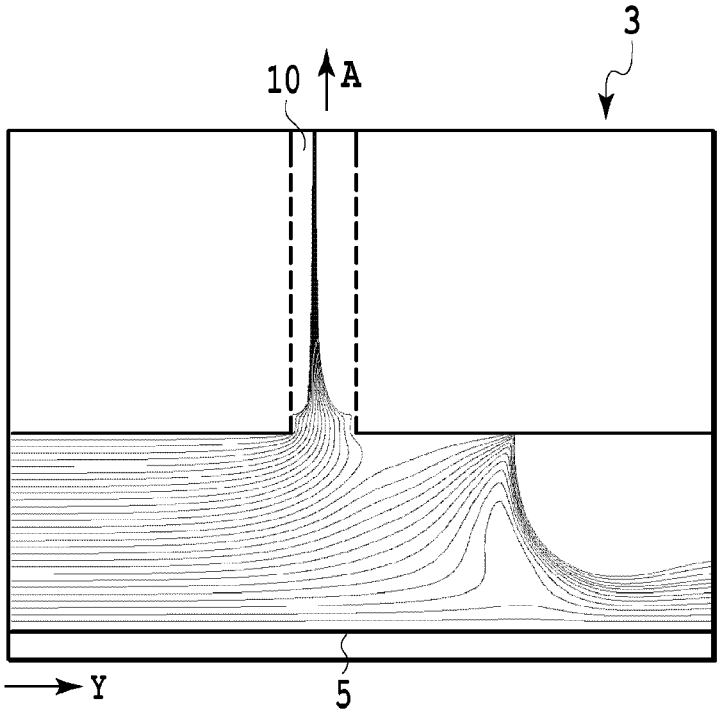
FIG. 14A illustrates a trajectory of ink mist in the ink mist collection section of FIG. 11.
Figure 14B:
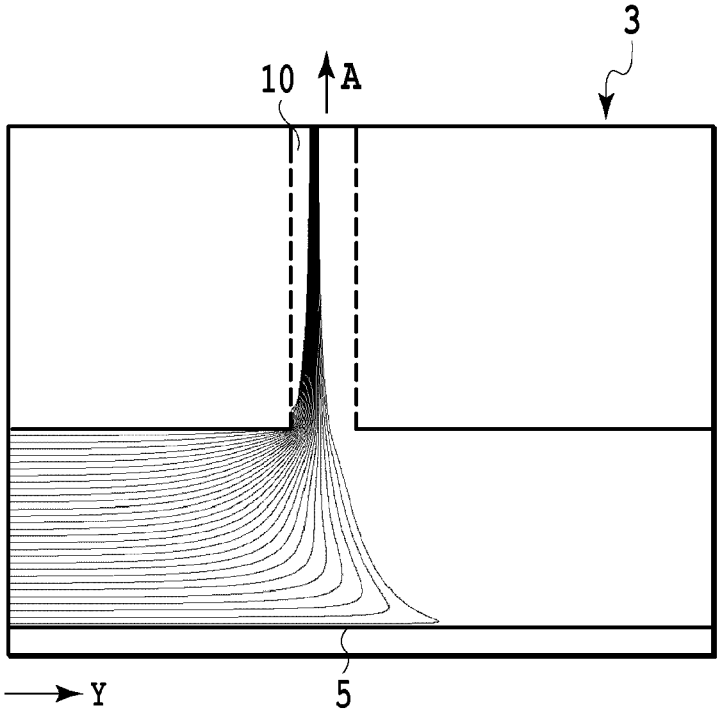
FIG. 14B illustrates a trajectory of ink mist in an ink mist collection section as a comparative example.

FIG. 14A illustrates a movement trajectory of ink mist M when airflow is produced at the suction port 4 in a direction opposite to the suction direction shown by arrow A, in a case where the ink mist M is collected as shown in FIG. 11 by the suction into the suction path 10 and the discharge of the air from the supply paths 7, 8, and 13. FIG. 14B illustrates a movement trajectory of ink mist M when airflow is not produced in a direction opposite to the suction direction shown by arrow A. As apparent from FIGS. 14A and 14B, when airflow is produced at the suction port 4 in a direction opposite to the suction direction shown by arrow A, the amount of collected ink mist is decreased.

On the other hand, if {(V1−2)+(V8−1)} is equal to or greater than 0, that is, if following formula (15) is satisfied, airflow is not produced at the suction port 4 in a direction opposite to the suction direction shown by arrow A.

$$V3\geq\{(V1-1)+V4+V5\} \quad (15)$$

The formulas (13) and (15) above can also be represented by the following formulas (13') and (15'), respectively.

$$Vin2=Vout-(Vin1+Vin3) \quad (13')$$

$$Vout\geq Vin1+Vin3 \quad (15'),$$

In the present embodiment, an amount Vin1 corresponds to V1−1, an amount Vin2 to {(V1−2)+(V8−1)}, an amount Vin3 to (V4+V5), and Vout to the flow rate V3.

In this embodiment, the suction into the suction path 10 and the discharge of the air from the supply paths 7, 8, and 13 allow efficient collection of the ink mist M while suppressing adhesion of the ink mist M to the side wall surface of the suction path 10.

Sixth Embodiment

In the present embodiment, even when a conveying speed of the print medium 5 changes in the above-described fifth embodiment, it is possible to suppress the adhesion of the ink mist M to the side wall surface of the suction path 10 and stably collect the ink mist M.

Figure 15:
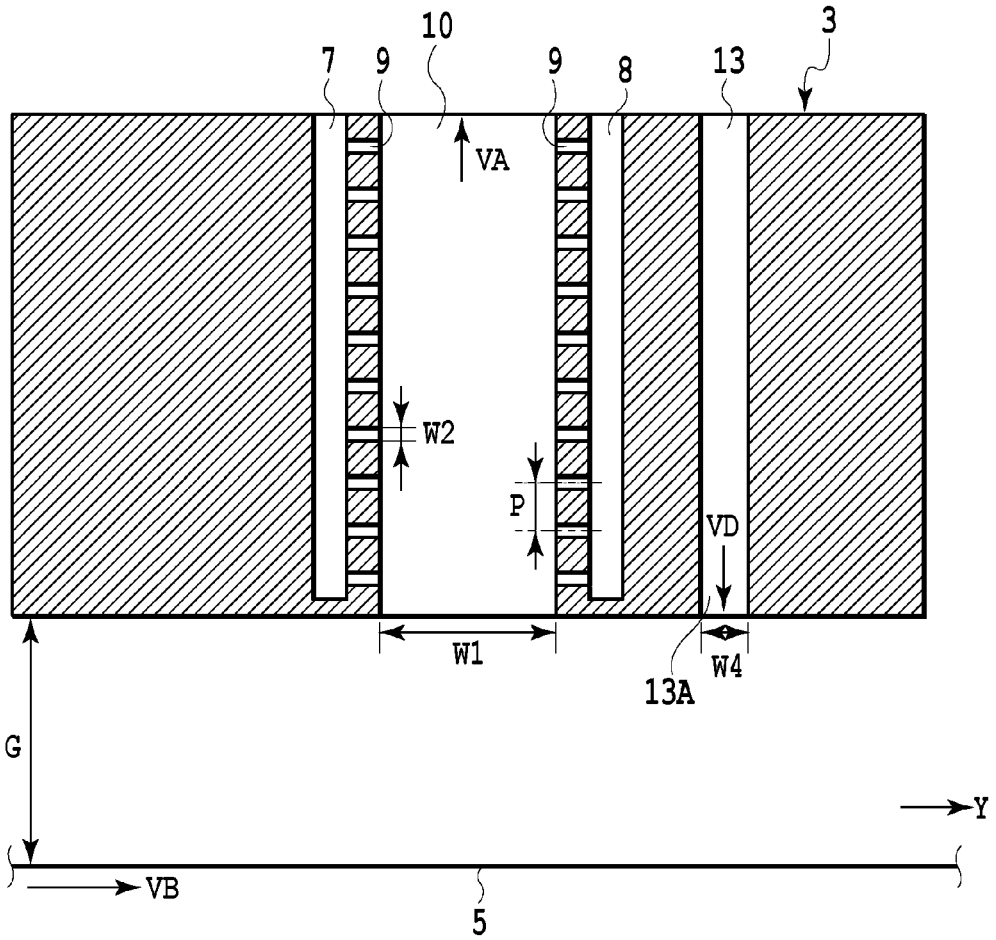
FIG. 15 is an enlarged view of an ink mist collection section according to a sixth embodiment of the present invention.

In FIG. 15, a width W4 of the discharge port 13A of the supply path 13 is 25 [μm], and a discharge speed VD of the air from the discharge port 13A is 15 [μm/s]. The widths W1 and W2, the interval P, the distance G, and the number of discharge ports 9 are the same as those of the second embodiment.

In the present embodiment, like the above-described fifth embodiment, the ink mist M is collected as shown in FIG. 11 by the suction into the suction path 10 and the discharge of the air from the supply paths 7, 8, and 13. In this configuration, the distance between the side wall surface of the suction path 10 and the ink mist M passing through the suction path 10 is equal to or greater than 125 [μm] if the relation of the above-mentioned formula (15) in which airflow is not produced at the suction port 4 in a direction opposite to the suction direction shown by arrow A is satisfied, and also the following formula (16) is satisfied.

$$\{V3-(V1-1)+V8\}\times0.38\leq V4\leq\{V3-(V1-1)+V8\}\times0.6 \quad (16)$$

In a case where the distance between the side wall surface of the suction path 10 and the ink mist M is 150 [μm], even if the conveying speed VB of the print medium 5 changes by 10% and the balance between the flow rate in the collection section 3 and the flow rate in an adjacent area changes, the ink mist M does not adhere to the side wall surface of the suction path 10. In this manner, if there is a sufficient distance between the side wall surface of the suction path 10 and the ink mist M, even when the conveying speed VB of the print medium 5 changes, it is possible to suppress the adhesion of the ink mist M to the side wall surface of the suction path 10 and maintain the performance on collection of the ink mist M.

Seventh Embodiment

Figure 16:
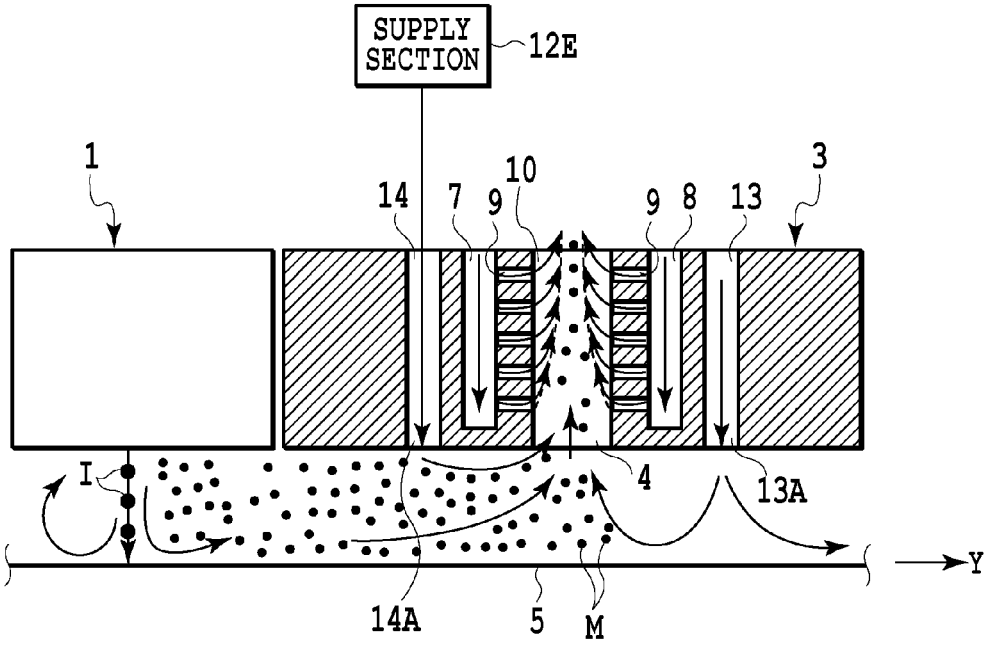
FIG. 16 is an enlarged cross-sectional view of an ink mist collection section according to a seventh embodiment of the present invention.

In the present embodiment, as shown in FIG. 16, in the configuration of the above-described fifth embodiment, a supply path 14 for receiving pressurized air (pressurized gas) from a supply section 12E is formed at a portion of the collection section 3 located upstream with respect to the suction port 4 in the conveying direction (arrow Y direction). An end of the supply path 14 is provided with a discharge port (upstream discharge port) 14A for discharging air that is supplied from the supply section 12E to the supply path 14 into the space between the collection section 3 and the print medium 5. It is also possible to integrate the supply section 12E, the supply sections 12A and 12B of FIG. 2A as described, and the supply section 12D of FIG. 11 into one and supply the pressurized air from one supply section to the supply paths 7, 8, 13, and 14.

The air in the supply path 14 is discharged from the discharge port 14A in a direction substantially perpendicular to the surface of the print medium 5. By discharging the air from the discharge port 14A to reach the print medium 5, the ink mist M floating near the surface of the print medium 5 is blown up toward the suction port 4. As a result, the ink mist M can be efficiently collected without increasing the amount of air sucked into the suction path 10.

In a case where an amount of air discharged from the discharge port 14A is small, a thickness of the layer of the airflow is small. Accordingly, after reaching the suction port 4, the air flows near the upstream side wall surface of the suction path 10 in the conveying direction (arrow Y direction). In this case, depending on the flow of the air, the ink mist M may adhere to the upstream side wall surface of the suction path 10 in the conveying direction. To suppress the adhesion of the ink mist M to the side wall surface of the suction path 10, in connection with the amount of air discharged from the discharge port 14A, the amount of air discharged from the discharge ports 9 of at least one of the supply paths 7 and 8 is set.

More specifically, first, air is not discharged from the discharge ports 9 of the supply paths 7 and 8 but air is discharged from the discharge port 14A of the supply path 14. In a case where the air is sucked into the suction path 10 from an upstream area with respect to the central position (midpoint between the upstream end and the downstream end in the conveying direction) of the suction port 4 in the conveying direction, the air is discharged from the discharge ports 9 of at least the supply path 7. Then, the amount of air discharged from the discharge ports 9 is set such that the position at which the air discharged from the discharge port 14A is sucked into the suction path 10 comes closer to the central position of the suction port 4. Accordingly, it is possible to further suppress the adhesion of the ink mist M to the side wall surface of the suction path 10.

Figure 17A:
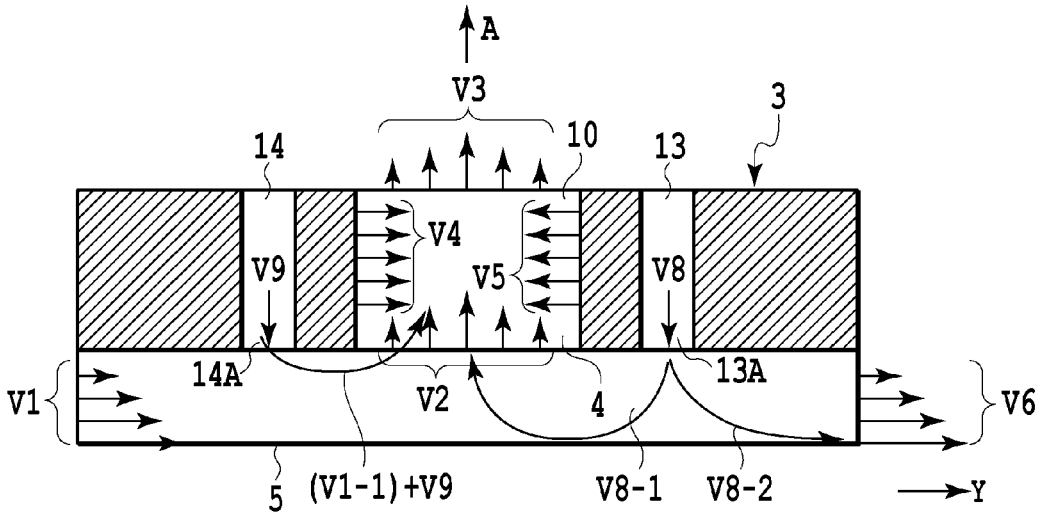
FIGS. 17A and 17B illustrate airflow in the ink mist collection section of FIG. 16.

FIG. 17A illustrates the flow rate of the air between the print medium 5 and the collection section 3 and the flow rate of the air in the suction path 10. The flow rate of the air discharged from the discharge port 14A of the supply path 14 is set as V9. The flow rates V1 to V6 and V8 are the same as those of the above embodiments. As described above, the air discharged from the discharge port 13A is diverted into the flow toward the suction port 4 and the flow from the discharge port 13A toward the downstream area in the conveying direction. The flow rate of the air flowing from the discharge port 13A to the suction port 4 is set as V8−1, and the flow rate of the air flowing from the discharge port 13A toward the downstream area in the conveying direction is set as V8−2. The flow rate V8−1 is represented by the following formula (17).

$$(V8-1)=V8-(V8-2) \tag{17}$$

Figure 17B:
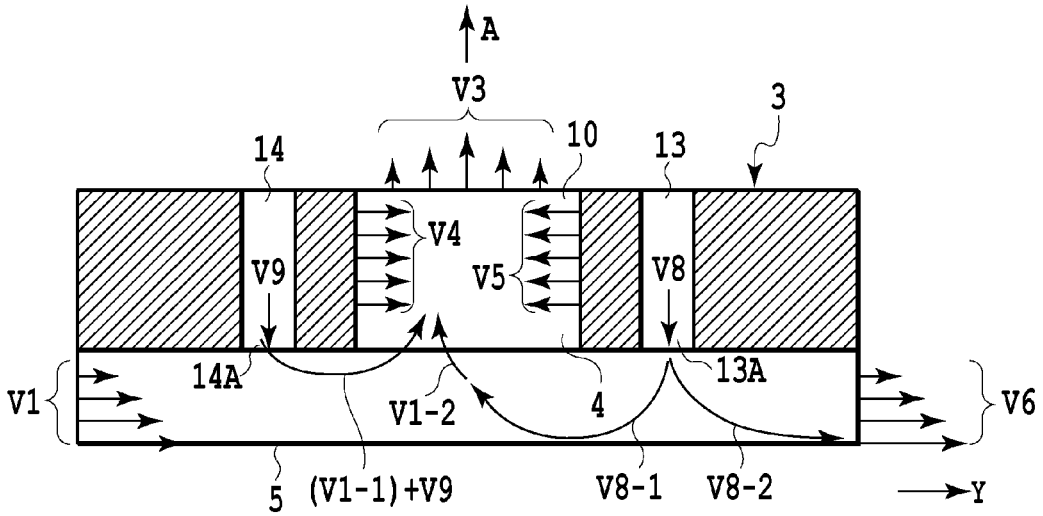

The flow rate V2, as shown in FIG. 17B, is considered as the sum of the flow rate V1−1, the flow rate V1−2, the flow rate V8−1, and the flow rate V8. The relation is represented by the following formula (18).

$$V2=(V1-1)+(V1-2)+(V8-1)+V9 \tag{18}$$

Based on the flow rate conservation law, the flow rate V1−2 can be represented by the following formula (19).

$$(V1-2)+(V8-1)=V3-\{(V1-1)+V4+V5+V9\} \tag{19}$$

If {(V1−2)+(V8−1)} is smaller than 0, that is, if the following formula (20) is satisfied, airflow is produced at the suction port 4 in a direction opposite to a suction direction shown by arrow A.

$$V3<\{(V1-1)+V4+V5+V9\} \tag{20}$$

Figure 18A:
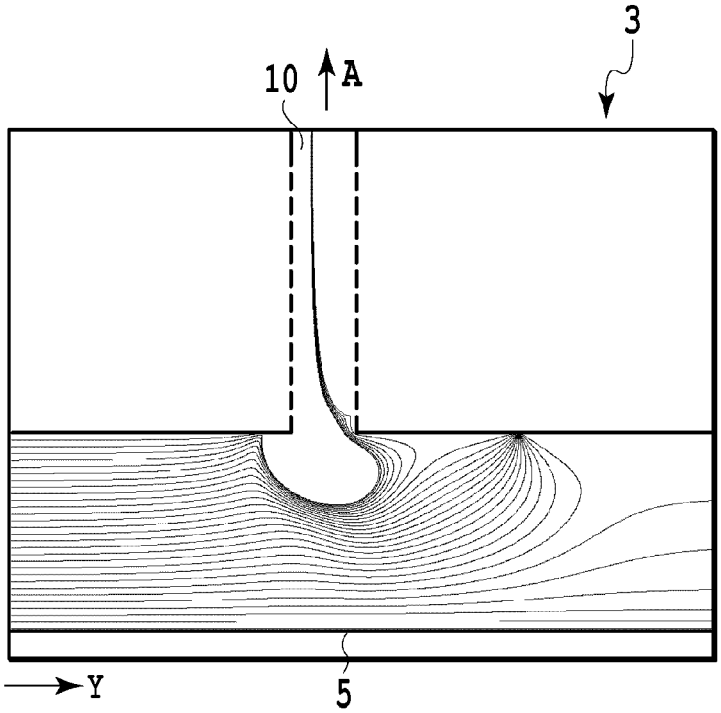
FIG. 18A illustrates a trajectory of ink mist in the ink mist collection section of FIG. 16.
Figure 18B:
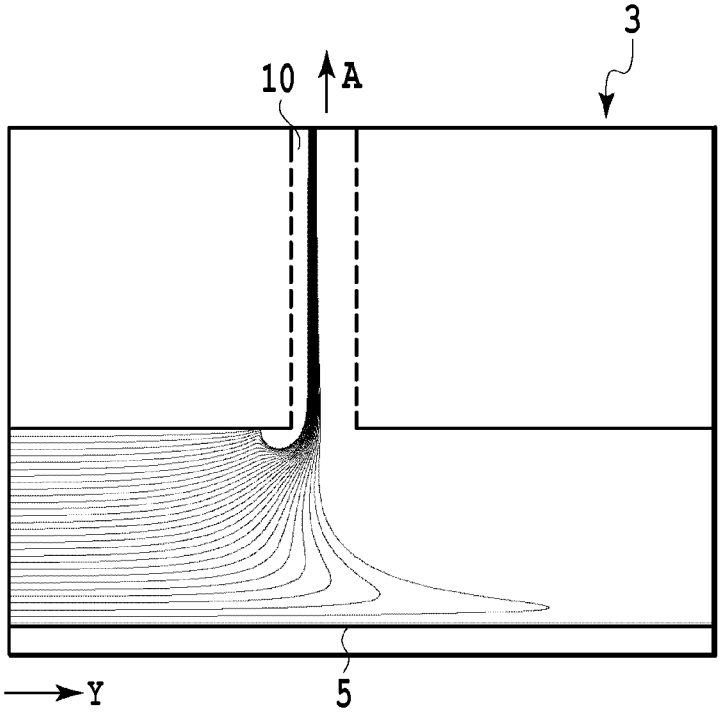
FIG. 18B illustrates a trajectory of ink mist in an ink mist collection section as a comparative example.

FIG. 18A illustrates a movement trajectory of ink mist M when airflow is produced at the suction port 4 in a direction opposite to the suction direction shown by arrow A, in a case where the ink mist M is collected as shown in FIG. 16 by the suction into the suction path 10 and the discharge of the air from the supply paths 7, 8, 13, and 14. FIG. 18B illustrates a movement trajectory of ink mist M when airflow is not produced in the direction opposite to the suction direction shown by arrow A. As apparent from FIGS. 18A and 18B, when airflow is produced at the suction port 4 in the direction opposite to the suction direction shown by arrow A, the amount of collected ink mist is decreased.

On the other hand, if {(V1−2)+(V8−1)} is equal to or greater than 0, that is, if the following formula (21) is satisfied, airflow is not produced at the suction port 4 in the direction opposite to the suction direction shown by arrow A.

$$V3\geq\{(V1-1)+V4+V5+V9\} \tag{21}$$

The formulas (19) and (21) above can also be represented by the following formula (19') and (21'), respectively.

$$Vin2=Vout-(Vin1+Vin3) \tag{19'}$$

$$Vout\geq Vin1+Vin3 \tag{21'}$$

In the present embodiment, Vin1 corresponds to {(V1−1)+V9}, Vin2 to {(V1−2)+(V8−1)}, Vin3 to (V4+V5), and Vout to the flow rate V3.

In this embodiment, the suction into the suction path 10 and the discharge of the air from the supply paths 7, 8, 13, and 14 allow efficient collection of the ink mist M while suppressing adhesion of the ink mist M to the side wall surface of the suction path 10 and to the opening surface of the suction port 4.

Eighth Embodiment

In the present embodiment, even when a conveying speed of the print medium 5 changes in the above-described seventh embodiment, it is possible to suppress the adhesion of the ink mist M to the side wall surface of the suction path 10 and stably collect the ink mist M.

Figure 19:
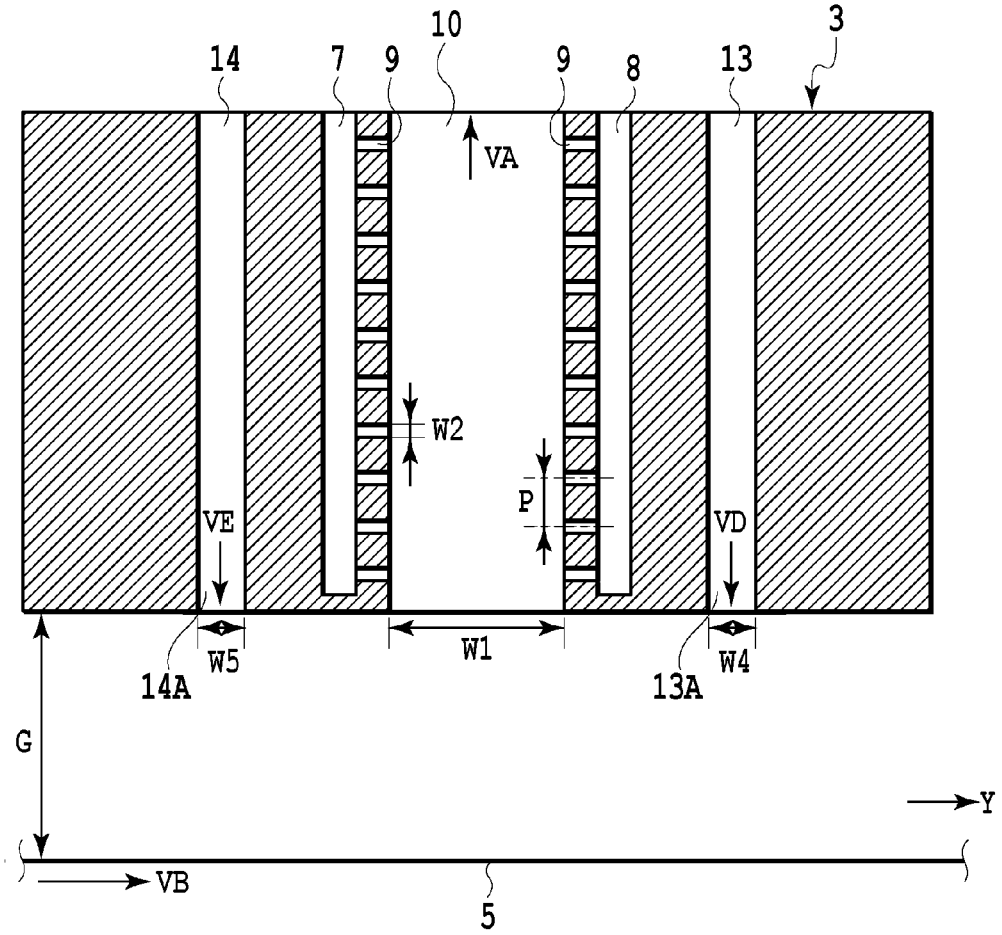
FIG. 19 is an enlarged view of a main part of an ink mist collection section according to an eighth embodiment of the present invention.

In FIG. 19, a width W5 of the discharge port 14A of the supply path 14 is 25 [μm], and a discharge speed VE of the air from the discharge port 14A is 15 [m/s]. The widths W1, W2, and W4, the interval P, the distance G, and the number of discharge ports 9 are the same as those of the seventh embodiment.

In the present embodiment, like the above-described seventh embodiment, the ink mist M is collected as shown in FIG. 16 by the suction into the suction path 10 and the discharge of the air from the supply paths 7, 8, 13, and 14. In this configuration, a distance between the side wall surface of the suction path 10 and the ink mist M passing through the suction path 10 is equal to or greater than 150 [μm] if the relation of the above-mentioned formula (21) in which airflow is not produced at the suction port 4 in the direction opposite to the suction direction shown by arrow A is satisfied, and also the following formula (22) is satisfied.

$$\{V3-(V1-1)+V8+V9\}\times0.15\leq V4\leq\{V3-(V1-1)+V8+V9\}\times0.6 \tag{22}$$

In a case where the distance between the side wall surface of the suction path 10 and the ink mist M is 125 [μm], even if the conveying speed VB of the print medium 5 changes by 10% and the balance between the flow rate in the collection section 3 and the flow rate in an adjacent area changes, the ink mist M does not adhere to the side wall surface of the suction path 10. In this manner, if there is a sufficient distance between the side wall surface of the suction path 10 and the ink mist M, even when the conveying speed VB of the print medium 5 changes, it is possible to suppress the adhesion of the ink mist M to the side wall surface of the suction path 10 and to the opening surface of the suction port 4. As a result, the performance on collection of the ink mist M can be maintained.

Other Embodiment

A collection section 3 may also form an ink mist collection apparatus that is separate from an ink jet printing apparatus and may be mounted on the ink jet printing apparatus. Furthermore, the print head 1 and the collection section 3 may move relative to a print medium 5.

Gas discharged from discharge ports 9 of supply paths 7 and 8 and gas discharged from discharge ports 11A, 13A, and 14A of supply paths 11, 13, and 14 are not limited to air, and may be an inert gas such as nitrogen. Furthermore, the above-described embodiments describe the mode of the suction port 4 located opposite to the print medium. However, the location of the suction port 4 is not limited to this, and the suction port 4 may be provided at any position as long as ink mist flies. To suck the ink mist more efficiently, the suction port 4 may be provided near a moving area of the print head 1. The suction port 4 may also be provided at the print head 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-260515 filed Dec. 17, 2013, and No. 2014-245388 filed Dec. 3, 2014, which are hereby incorporated by reference wherein in their entirety.

What is claimed is:

1. An ink mist collection apparatus for collecting ink mist that is produced when an image is printed on a print medium in an ink jet printing apparatus, the ink jet printing apparatus printing the image on the print medium by moving a print head relative to the print medium while ejecting ink from the print head, the ink mist collection apparatus comprising:

a suction unit configured to suck air above the print medium with the ink mist, from a suction port through a suction path, the suction port being located downstream of the print head with respect to a moving direction of the print medium relative to the print head and being opposite to the print medium; and an inner discharge unit configured to discharge gas from an inner discharge port into the inside of the suction path, wherein the inner discharge port includes at least one of a first inner discharge port located at a downstream portion of an inner wall of the suction path with respect to the moving direction and a second inner discharge port located at an upstream portion of the inner wall of the suction path with respect to the moving direction.

2. The ink mist collection apparatus according to claim 1, wherein the inner discharge unit includes a supply section of pressurized gas and a supply path for supplying the pressurized gas from the supply section to the inner discharge port.

3. The ink mist collection apparatus according to claim 1, wherein the suction unit sucks air from the suction port such that flow of air is not produced at a position near the suction port in a direction opposite to a suction direction of air in the suction path when the image is printed.

4. The ink mist collection apparatus according to claim 3, wherein the following relation is satisfied: $Vout \geq Vin1 + Vin3$, where Vin1 is an amount of airflow sucked into the suction port from an upstream area upstream of the suction port with respect to the moving direction, Vin2 is an amount of airflow sucked into the suction port from a downstream area downstream of the suction port with respect to the moving direction into the suction port, Vin3 is an amount of gas discharged from the inner discharge port into the inside of the suction path, and Vout is an amount of air and gas sucked into the suction path.

5. The ink mist collection apparatus according to claim 4, further comprising an upstream discharge unit configured to discharge gas to the print medium from an upstream discharge port located upstream of the suction port with respect to the moving direction and located between the suction port and the print head, wherein the amount Vin1 includes air sucked into the suction port and gas discharged from the upstream discharge port and sucked into the suction port.

6. The ink mist collection apparatus according to claim 4, further comprising a downstream discharge unit configured to discharge gas to the print medium from a downstream discharge port located downstream of the suction port with respect to the moving direction, wherein the amount Vin2 includes air sucked into the suction port and gas discharged from the downstream discharge port and sucked into the suction port.

7. The ink mist collection apparatus according to claim 1, wherein the suction unit sucks air from the suction port such that a flow of air is not produced at a position near the suction port downstream with respect to the suction port in the moving direction when the image is printed, the flow of air flowing from the suction port toward the position near the suction port.

8. An ink jet printing apparatus comprising the ink mist collection apparatus according to claim 1.

9. An ink mist collection apparatus for collecting ink mist that is produced when an image is printed on a print medium in an ink jet printing apparatus, the ink jet printing apparatus printing the image on the print medium by moving a print head relative to the print medium while ejecting ink from the print head, the ink mist collection apparatus comprising:

a suction unit configured to suck air above the print medium with the ink mist, from a suction port through a suction path, the suction port being located downstream of the print head with respect to a moving direction of the print medium relative to the print head and being opposite to the print medium;

an inner discharge unit configured to discharge gas from an inner discharge port into the inside of the suction path; and at least one of an upstream discharge unit and a downstream discharge unit, the upstream discharge unit being configured to discharge gas to the print medium from an upstream discharge port located upstream of the suction port with respect to the moving direction and located between the suction port and the print head, the downstream discharge unit being configured to discharge gas to the print medium from a downstream discharge port located downstream of the suction port with respect to the moving direction.

10. The ink mist collection apparatus according to claim 9, comprising the upstream discharge unit, wherein the upstream discharge unit discharges gas sucked into the suction path from the suction port when the image is printed; and wherein the inner discharge unit discharges gas from the inner discharge port such that the gas discharged from the upstream discharge port is sucked from a central position of the suction port.

11. The ink mist collection apparatus according to claim 9, comprising the downstream discharge unit, wherein the downstream discharge unit discharges gas from the downstream discharge port in a direction substantially perpendicular to a surface of the print medium.

12. An ink mist collection method for collecting ink mist that is produced when an image is printed on a print medium in an ink jet printing apparatus, the ink jet printing apparatus printing the image on the print medium by moving a print head relative to the print medium while ejecting ink from the print head, the method comprising the steps of:

sucking air above the print medium with the ink mist, from a suction port through a suction path, the suction port being located downstream of the print head with respect to a moving direction of the print medium relative to the print head and being opposite to the print medium; and discharging gas into the inside of the suction path from at least one of a first inner discharge port located at a downstream portion of an inner wall of the suction path with respect to the moving direction and a second inner discharge port located at an upstream portion of the inner wall of the suction path with respect to the moving direction.

13. An ink mist collection apparatus comprising:

a suction port located opposite to a print medium and located downstream of an ejection port with respect to a direction of a relative movement of the ejection port and the print medium, the ejection port ejecting ink to the print medium during the relative movement with the print medium; and a suction path that is in communication with the suction port and sucks mist ejected from the ejection port through the suction port, wherein a wall surface of the suction path is provided with a discharge port for discharging gas into the inside of the suction path.

14. The ink mist collection apparatus according to claim 13, further comprising an upstream discharge port located upstream of the suction port with respect to the direction of the relative movement and located between the suction port and the ejection port, the upstream discharge port discharging gas to the print medium.

15. The ink mist collection apparatus according to claim 13, further comprising a downstream discharge port located downstream of the suction port with respect to the direction of the relative movement, the downstream discharge port discharging gas to the print medium.

* * * * *